US010151091B2

(12) United States Patent
Shiraishi et al.

(10) Patent No.: US 10,151,091 B2
(45) Date of Patent: Dec. 11, 2018

(54) TOILET APPARATUS

(71) Applicant: TOTO LTD., Kitakyushu-shi, Fukuoka (JP)

(72) Inventors: Masateru Shiraishi, Kitakyushu (JP); Satoshi Yamazaki, Kitakyushu (JP); Tomohiro Noguchi, Kitakyushu (JP); Koji Yamamoto, Kitakyushu (JP)

(73) Assignee: TOTO LTD., Kitakyushu-shi, Fukuoka (JP)

( * ) Notice: Subject to any disclaimer, the term of this patent is extended or adjusted under 35 U.S.C. 154(b) by 72 days.

(21) Appl. No.: 15/233,027

(22) Filed: Aug. 10, 2016

(65) Prior Publication Data

US 2017/0051489 A1 Feb. 23, 2017

(30) Foreign Application Priority Data

Aug. 21, 2015 (JP) ..... 2015-163973

(51) Int. Cl.
*E03D 9/08* (2006.01)
*E03D 11/02* (2006.01)

(52) U.S. Cl.
CPC ..... *E03D 9/08* (2013.01); *E03D 11/02* (2013.01)

(58) Field of Classification Search
CPC ..... E03D 9/08; E03D 11/02
USPC ..... 4/252.2, 420.1–420.5
See application file for complete search history.

(56) References Cited

U.S. PATENT DOCUMENTS 7,875,173 B1 * 1/2011 Barnes ..... A61H 33/14 210/167.1
2014/0259351 A1 * 9/2014 Spankowski ..... E03D 11/02 4/420.5
2014/0259352 A1 9/2014 Jones et al.
2016/0186421 A1 * 6/2016 Lammel ..... E03D 9/08 4/420.5

FOREIGN PATENT DOCUMENTS

WO WO 2014170465 A1 * 10/2014 ..... E03D 9/08

* cited by examiner

*Primary Examiner* — Christine Skubinna
(74) *Attorney, Agent, or Firm* — Amin, Turocy & Watson LLP

(57) ABSTRACT

A toilet apparatus according to an embodiment includes a wall-mounted-type toilet body, a sanitary washing device, a switching part, and a fixation member. The toilet body includes a skirt part that forms an outline of a toilet bowl. The sanitary washing device is disposed on a top face of the toilet body and washes a private part of a user. The switching part can execute at least one of a first operation and a second operation, wherein the first operation is to switch a supply and a stop of water to the sanitary washing device, and the second operation is to switch a supply and a stop of electric power to the sanitary washing device, and wherein the first operation and the second operation are executed manually. The fixation member fixes the switching part at a manually operable position inside the skirt part, wherein the switching part is manually operable at the position.

9 Claims, 14 Drawing Sheets

TOILET APPARATUS

CROSS-REFERENCE TO RELATED APPLICATION

This application is based upon and claims the benefit of priority from the prior Japanese Patent Application No. 2015-163973, filed on Aug. 21, 2015, the entire contents of which are incorporated by reference.

FIELD

An embodiment of the disclosure relates to a toilet apparatus.

BACKGROUND

Conventionally, a toilet apparatus has been known that includes a wall-mounted-type toilet body and a sanitary washing device that is provided on a top face of the toilet body and washes a private part of a user (see, for example, Japanese Laid-Open Patent Publication No. 2015-031140).

A water supplying system and an electric power supplying system are connected to the above-mentioned sanitary washing device. Such a water supplying system includes a water stop valve that executes switching between water supplying and water stopping for the sanitary washing device by a manual operation, while such an electric power supplying system includes an electrical outlet plug that executes switching between electric power supplying and electric power supply stopping for the sanitary washing device by a manual operation. In a conventional technique, the above-mentioned water stop valve or electrical outlet plug is configured to be disposed inside, and hidden by, a wall that is mounted with the toilet body.

However, in a case where a user executes water stopping or electric power supply stopping, for example, in an event of emergency, such water stopping or the like is difficult to be readily executed because a water stop valve or the like in a conventional technique is disposed inside a wall that is difficult to be accessed by such a user.

SUMMARY

A toilet apparatus according to an embodiment includes a wall-mounted-type toilet body, a sanitary washing device, a switching part, and a fixation member. The toilet body includes a skirt part that forms an outline of a toilet bowl. The sanitary washing device is disposed on a top face of the toilet body and washes a private part of a user. The switching part can execute at least one of a first operation and a second operation, wherein the first operation is to switch a supply and a stop of water to the sanitary washing device, and the second operation is to switch a supply and a stop of electric power to the sanitary washing device, and wherein the first operation and the second operation are executed manually. The fixation member fixes the switching part at a manually operable position inside the skirt part, wherein the switching part is manually operable at the position.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENTS

Hereinafter, embodiments of a toilet apparatus disclosed in the present application will be described in detail, with reference to the accompanying drawings. This invention is not limited to embodiments described below.

First Embodiment

Figure 1:
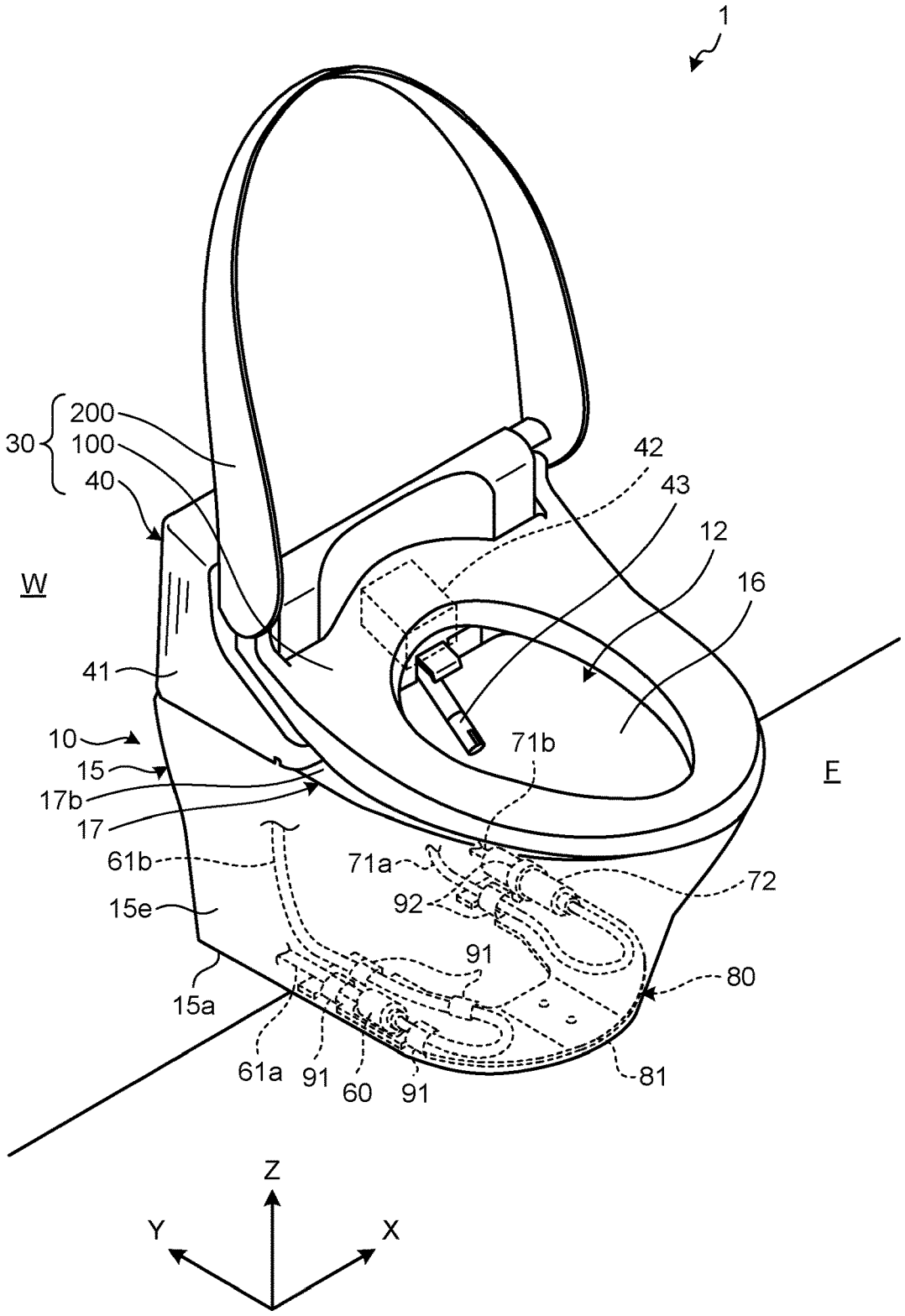
FIG. 1 is a perspective view illustrating a toilet apparatus according to a first embodiment.

FIG. 1 is a perspective view illustrating a toilet apparatus according to a first embodiment. For readily understanding the descriptions, a direction of an X-axis, a direction of a Y-axis, and a direction of a Z-axis that are orthogonal to one another are defined in FIG. 1 and a three-dimensional orthogonal coordinate system with a positive direction of the Z-axis that is a vertically upward direction is illustrated therein. Such an orthogonal coordinate system may also be illustrated in other drawings to be used for an explanation described below. Any of FIG. 1, FIG. 2 and subsequent figures is a schematic diagram.

As illustrated in FIG. 1, a toilet apparatus 1 includes a toilet body (that may be described as a "toilet" below) 10 and a sanitary washing device 30 that is provided or disposed on a top face of the toilet 10. The toilet 10 is a wall-mounted-type Western-style toilet bowl that is mounted on a wall W that stands on a floor face F of a toilet room. Mounting of the above-mentioned toilet 10 on the wall W will be described later. Although the wall W is formed of a material that includes, for example, a tile, a mortar, or the like, a material of the wall W is not limited thereto.

Figure 2:
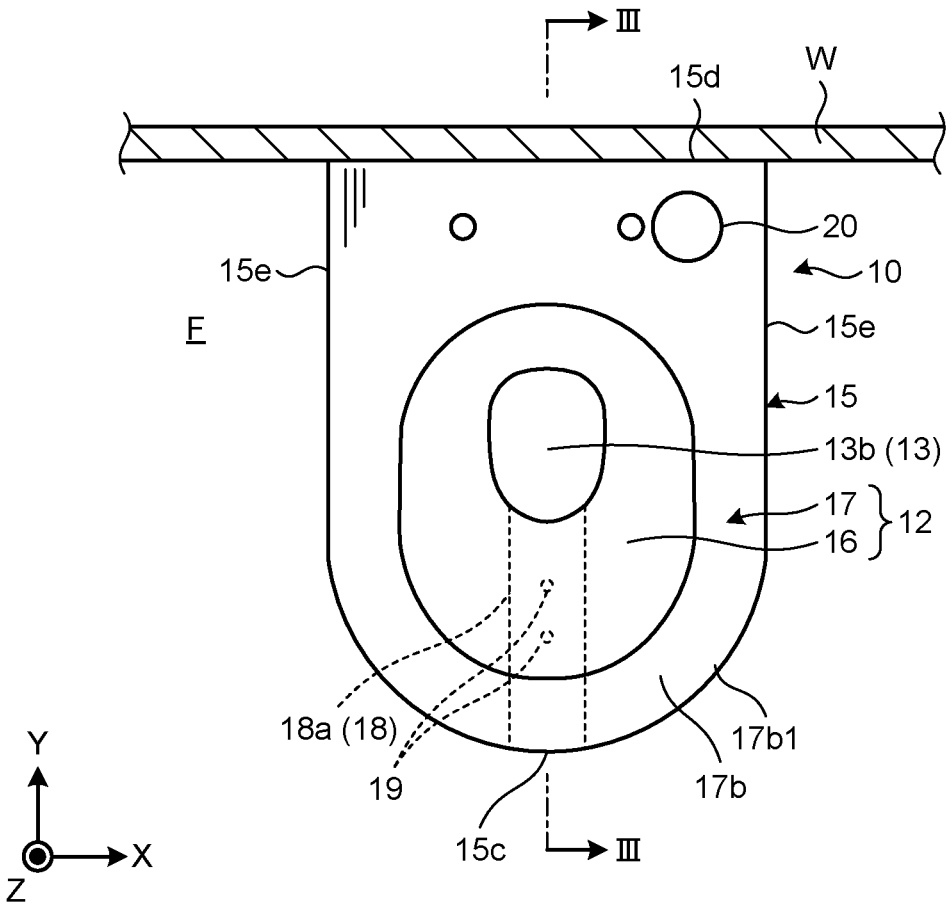
FIG. 2 is a plan view illustrating a toilet in a state where a sanitary washing device is detached.
Figure 3:
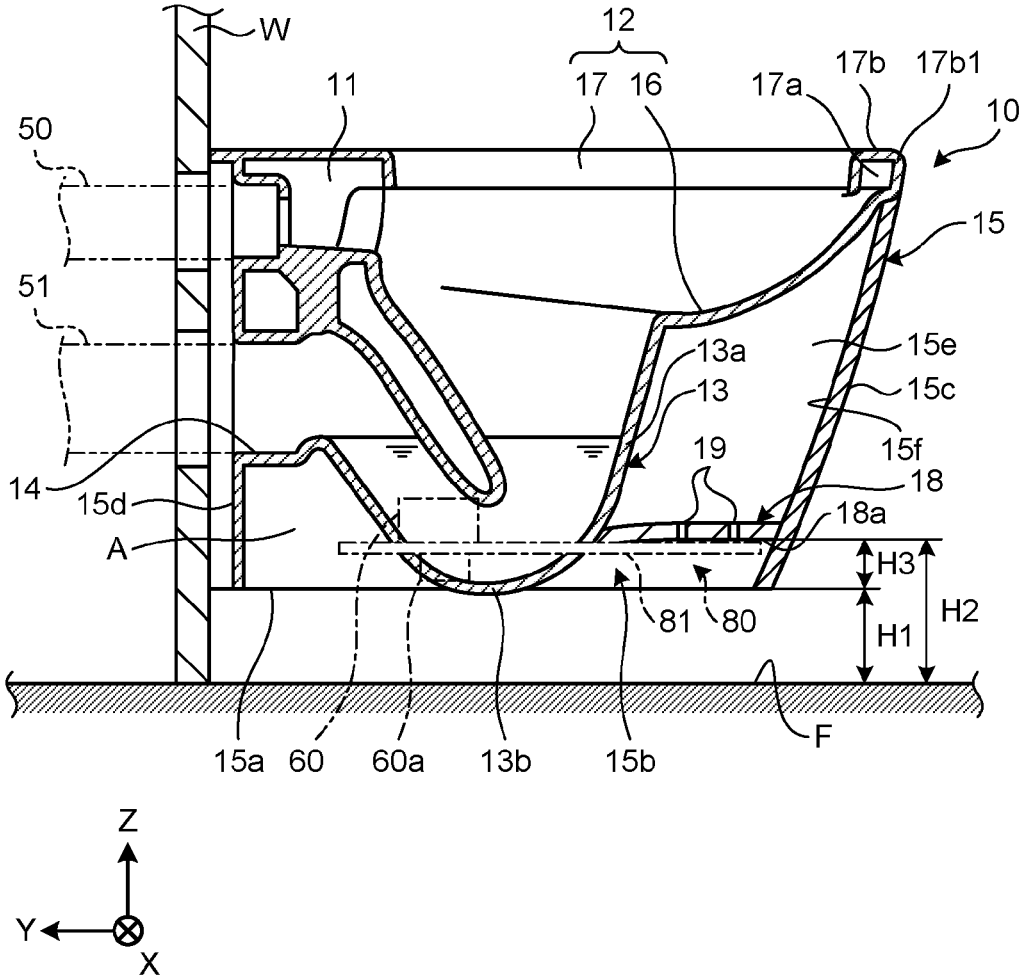
FIG. 3 is a cross-sectional view along a line III-III of FIG. 2.

FIG. 2 is a plan view illustrating the toilet 10 in a state where the sanitary washing device 30 is detached therefrom, and FIG. 3 is a cross-sectional view along a line III-III of FIG. 2. As illustrated in FIG. 2 and FIG. 3, the toilet 10 includes a headrace channel 11 (see FIG. 3), a bowl part 12, a drain trap pipeline 13, a drainage channel 14 (see FIG. 3), and a skirt part 15.

As illustrated in FIG. 3, the headrace channel 11 is connected to one end of a washing water supplying pipe 50 that protrudes from the wall W. The other end of the washing water supplying pipe 50 is connected to a (not-illustrated) tank for washing water disposed inside the wall W. Therefore, washing water supplied from a tank flows through the headrace channel 11 in a case where toilet washing is executed.

The bowl part 12 is connected to the headrace channel 11 and is formed into a bowl shape capable of receiving sewage. In detail, the bowl part 12 includes a sewage-receiving face 16 capable of receiving sewage and a rim part 17 that is formed at an upper edge of the sewage-receiving face 16.

For the rim part 17, a rim headrace channel 17*a* is formed that is connected to the headrace channel 11. The rim headrace channel 17*a* is provided with a discharge port on a side of the sewage-receiving face 16, and hence, washing water through the headrace channel 11 is discharged to the sewage-receiving face 16 through the discharger port of the rim headrace channel 17*a* so that the sewage-receiving face 16 is washed.

The drain trap pipeline 13 includes an inlet part 13*a* and a water storage part 13*b*. The inlet part 13*a* is provided so as to be continuous with a bottom of the sewage-receiving face 16 and causes washing water from the bowl part 12 to flow into the drain trap pipeline 13. The water storage part 13*b* is formed so as to extend downwardly from the inlet part 13*a* and further extend obliquely upwardly so that a shape is provided to store a predetermined amount of washing water. Thus, washing water is stored in the water storage part 13*b* and the drain trap pipeline 13 functions as water sealing, so that an odor or the like from the a drain pipe 51 is prevented from flowing backwardly toward a side of the bowl part 12.

The drainage channel 14 is such that a side of one end thereof is connected to an exit of the drain trap pipeline 13 while a side of the other end thereof is connected to the drain pipe 51. Therefore, in a case where toilet washing is executed, washing water that has washed the sewage-receiving face 16 is drained to the drain pipe 51 through the inlet part 13*a* and the water storage part 13*b* of the drain trap pipeline 13 and the drainage channel 14.

The skirt part 15 forms an outline of the toilet 10. The skirt part 15 covers the above-mentioned bowl part 12 or drain trap pipeline 13 on a periphery side to form an outline of a toilet bowl. In detail, the skirt part 15 is formed so as to extend from a periphery 17*b*1 of a top face 17*b* of the rim part 17 toward a side of the floor face F on a downside thereof, and configured to surround the bowl part 12 or the like.

Therefore, the above-mentioned bowl part 12 or drain trap pipeline 13 or the like is housed inside the skirt part 15, and a space is formed at a part other than the bowl part 12 or the like. Hereinafter, a space that is formed inside the skirt part 15 may be described as an "internal space A".

An opening 15*b* is formed at a lower end 15*a* of the skirt part 15. Thereby, the internal space A of the skirt part 15 is communicated with outside air (accurately, an indoor space of a toilet room) through the opening 15*b*.

A height H1 of the lower end 15*a* of the skirt part 15 from the floor face F is approximately settable, and for example, it is preferable to set such a height in such a manner that a hand of a user is put in a lower part of the toilet 10.

The above-mentioned skirt part 15 is formed integrally with the bowl part 12, is not limited thereto, and may be formed separately therefrom. Hereinafter, in a case where the bowl part 12 is a reference inside the skirt part 15, a part in a negative direction of a Y-axis, a part on a side of the wall W in a positive direction of the Y-axis, and parts in a positive direction and a negative direction of an X-axis may be described as a "front face part 15*c*", a "back face part 15*d*", and "side face parts 15*e*", respectively.

As illustrated in FIG. 1, the sanitary washing device 30 is provided on a top face of the toilet 10, accurately the top face 17*b* of the rim part 17, and washes a private part of a user. Specifically, the sanitary washing device 30 includes a body part 40, a toilet seat 100, and a toilet lid 200. Both the toilet seat 100 and the toilet lid 200 are mounted on the body part 40 so as to be openable and closable.

The body part 40 includes a case 41 and a nozzle unit 42. The case 41 houses the nozzle unit 42 or the like. The nozzle unit 42 includes a washing nozzle 43.

The above-mentioned washing nozzle 43 is configured to be movable forward and backward relative to the case 41. In detail, the washing nozzle 43 is connected to a non-illustrated driving source such as an electric motor. Such a driving source is connected to a non-illustrated electric power source to supply electric power thereto. The washing nozzle 43 is moved forward and backward between a position where it has moved forward into the bowl part 12 of the toilet 10 and a position where it has moved backward into and is housed in the case 41, by driving of a driving source. FIG. 1 illustrates the washing nozzle 43 at a position where it has moved forward.

The washing nozzle 43 is connected to a non-illustrated water source such as a water supply pipe. The washing nozzle 43 discharges water from a water source to a body of a user to wash his or her private part when it is provided at a position where it has moved forward into the bowl part 12. In the present specification, an expression of "water" does not necessarily mean cold water but may be used to mean that hot water is included.

Thus, a water supplying system from a water source and an electric power supplying system from an electric power source are connected to the sanitary washing device 30 in order to execute a washing operation of washing a private part of a user. In the sanitary washing device 30, a load for supplying electric power from an electric power supplying system is not limited to the above-mentioned driving source and may include, for example, an electromagnetic valve that opens or closes a flow channel for supplying water to the washing nozzle 43, a heater that heats water supplied from a water source, or the like.

Meanwhile, the above-mentioned water supplying system includes a (not-illustrated) water stop valve that executes switching between water supplying and water stopping for the sanitary washing device 30 by a manual operation. An electric power supplying system includes an (non-illustrated) electrical outlet plug that executes switching between electric power supplying and electric power supply stopping for the sanitary washing device 30 by a manual operation. The above-mentioned water stop valve or electrical outlet plug may be disposed inside, and hidden by, the wall W.

However, if a water stop valve or the like is disposed inside the wall W that is difficult to be accessed by a user, it is difficult for a user to readily execute water stopping or the like in a case where a need to quickly stop water supplying or electric power supplying for the sanitary washing device 30 arises, for example, in an event of emergency or the like. A "user" in the present specification is not limited to a person that utilizes the toilet apparatus 1 and may be used to mean that, for example, a person that executes a variety of work such as water stopping for the sanitary washing device 30 is included.

In such a situation, as illustrated in FIG. 1, the toilet apparatus 1 according to the present embodiment includes a valve 60 that executes switching between water supplying and water stopping for the sanitary washing device 30 by a manual operation, and a connection terminal 72 that executes switching between electric power supplying and electric power supply stopping for the sanitary washing device 30 by a manual operation. The toilet apparatus 1 further includes a fixation member 80 that positions and fixes the above-mentioned valve 60 and connection terminal 72 at manually operable positions inside the skirt part 15. FIG. 1 illustrates a configuration inside the skirt part 15 partially transparently for convenience of understanding.

Thereby, a user can readily execute switching between water supplying and water stopping or switching between electric power supplying and electric power supply stopping, for the sanitary washing device 30, by manually operating the valve 60 or the connection terminal 72, for example, in an event of emergency.

Figure 4:
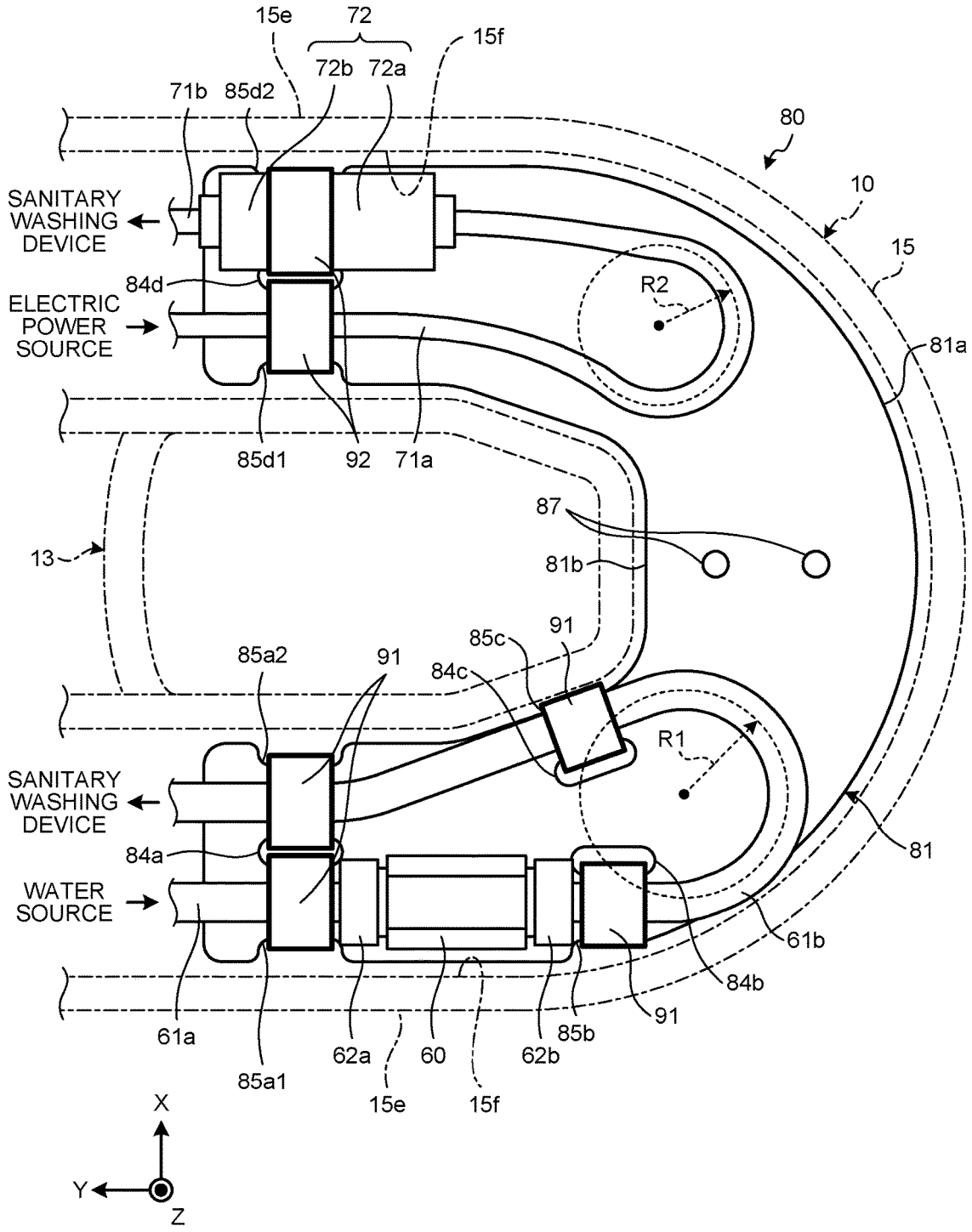
FIG. 4 is a plan view of a fixation member.

Hereinafter, a configuration of the toilet apparatus 1 will be described in more detail. FIG. 4 is a plan view of the fixation member 80 of the toilet apparatus 1 illustrated in FIG. 1. FIG. 4 represents an outline of the toilet 10 with dashed-dotted lines, for convenience of understanding.

As illustrated in FIG. 1 and FIG. 4, the toilet apparatus 1 includes a first water supplying pipe 61*a*, a second water supplying pipe 61*b*, a first electric power supply cord 71*a*, and a second electric power supply cord 71*b*. As illustrated in FIG. 4, the first water supplying pipe 61*a* is such that one end thereof is connected to a water source while the other end thereof is provided with a first connection member 62*a*. The second water supplying pipe 61*b* is such that one end thereof is connected to the sanitary washing device 30 while the other end thereof is provided with a second connection member 62*b*. For example, a freely bendable or flexible hose can be used for the first or second water supplying pipe 61*a* or 61*b* that is not limited thereto.

The first connection member 62*a* for the first water supplying pipe 61*a* and the second connection member 62*b* for the second water supplying pipe 61*b* are connected to one another through the above-mentioned valve 60. For example, a ball valve that includes an operation part 60*a* (not illustrated in FIG. 4, see FIG. 6A) that is manually operable by a user can be used for the valve 60 that is not limited thereto. That is, the valve 60 may be another kind of valve, for example, a handle-type gate valve or the like.

Therefore, for example, in a case where the valve 60 is opened by a manual operation, water supplying for the sanitary washing device 30 is executed. As the valve 60 is closed by a manual operation, a water supplying state for the sanitary washing device 30 is switched into a water stopping state. The valve 60 is an example of a switching part that switches between water supplying and water stopping for the sanitary washing device 30. The first water supplying pipe 61*a* and the second water supplying pipe 61*b* are examples of an extending member that extends from the valve 60 as a switching part. Herein, switching between water supplying and water stopping for the sanitary washing device 30 may be referred to as a first operation. Namely, the first operation is to switch a supply and a stop of water to the sanitary washing device 30. The first operation is executed manually. A position for disposition or the like of the above-mentioned valve 60 will be described in detail later.

The above-mentioned connection terminal 72 includes a first connection terminal 72*a* and a second connection terminal 72*b*. The first connection terminal 72*a* is provided on an end of the first electric power supply cord 71*a* and the second connection terminal 72*b* is provided on an end of the second electric power supply cord 71*b*.

In detail, the first electric power supply cord 71*a* is such that one end thereof is connected to an electric power source while the other end thereof is provided with the first connection terminal 72*a*. The second electric power supply cord 71*b* is such that one end thereof is connected to the sanitary washing device 30 while the other end thereof is provided with the second connection terminal 72*b*. Both the first and second electric power supply cords 71*a* and 71*b* are freely bendable electric power supply cords.

The first connection terminal 72*a* and the second connection terminal 72*b* are connected to one another so that the first electric power supply cord 71*a* and the second electric power supply cord 71*b* are electrically connected to one another, and thereby, electric power supplying is executed for the sanitary washing device 30. For example, as the first connection terminal 72*a* is detached from the second connection terminal 72*b* by a manual operation, an electric power supplying state for the sanitary washing device 30 is switched into an electric power supply stopping state. The connection terminal 72 is an example of a switching part that switches between electric power supplying and electric power supply stopping for the sanitary washing device 30. The first electric power supply cord 71*a* and the second electric power supply cord 71*b* are examples of an extending member that extends from the connection terminal 72 as a switching part. Herein, switching between electric power supplying and electric power supply stopping for the sanitary washing device 30 may be referred to as a second operation. Namely, the second operation is to switch a supply and a stop of electric power to the sanitary washing device 30. The second operation is executed manually. A position for disposition or the like of the above-mentioned connection terminal 72 will be described in detail later.

A water supplying system that includes the first or second water supplying pipe 61*a* or 61*b* or the valve 60 and an electric power supplying system that includes the first or second electric power supply cord 71*a* or 71*b* or the connection terminal 72, as being configured as described above, are fixed on the fixation member 80.

As illustrated in FIG. 1 and FIG. 4, the fixation member 80 includes a mounting member 81 and a constraint member 91 or 92 that constrains the first or second water supplying pipe 61*a* or 61*b* or the first or second electric power supply cord 71*a* or 71*b* on the mounting member 81 to fix the valve 60 or the connection terminal 72 thereon.

For example, the constraint member 91 or 92 is formed into a band shape or a substantially band shape, and is an integrated hook-and-loop fastener with a male part and a female part that are formed on one face and the other face thereof, respectively. In the above descriptions, a hook-and-loop fastener is used for the constraint member 91 or 92 that is not limited thereto, and for example, a banding band or the like may be used. The constraint member 91 is a constraint member for a water supplying system and the constraint member 92 is a constraint member for an electric power supplying system.

The mounting member 81 is installed in or mounted on the toilet 10, and the above-mentioned valve 60 or connection terminal 72 or the like is mounted thereon. Hereinafter, the mounting member 81 may be described as a "bracket 81".

Figure 5:
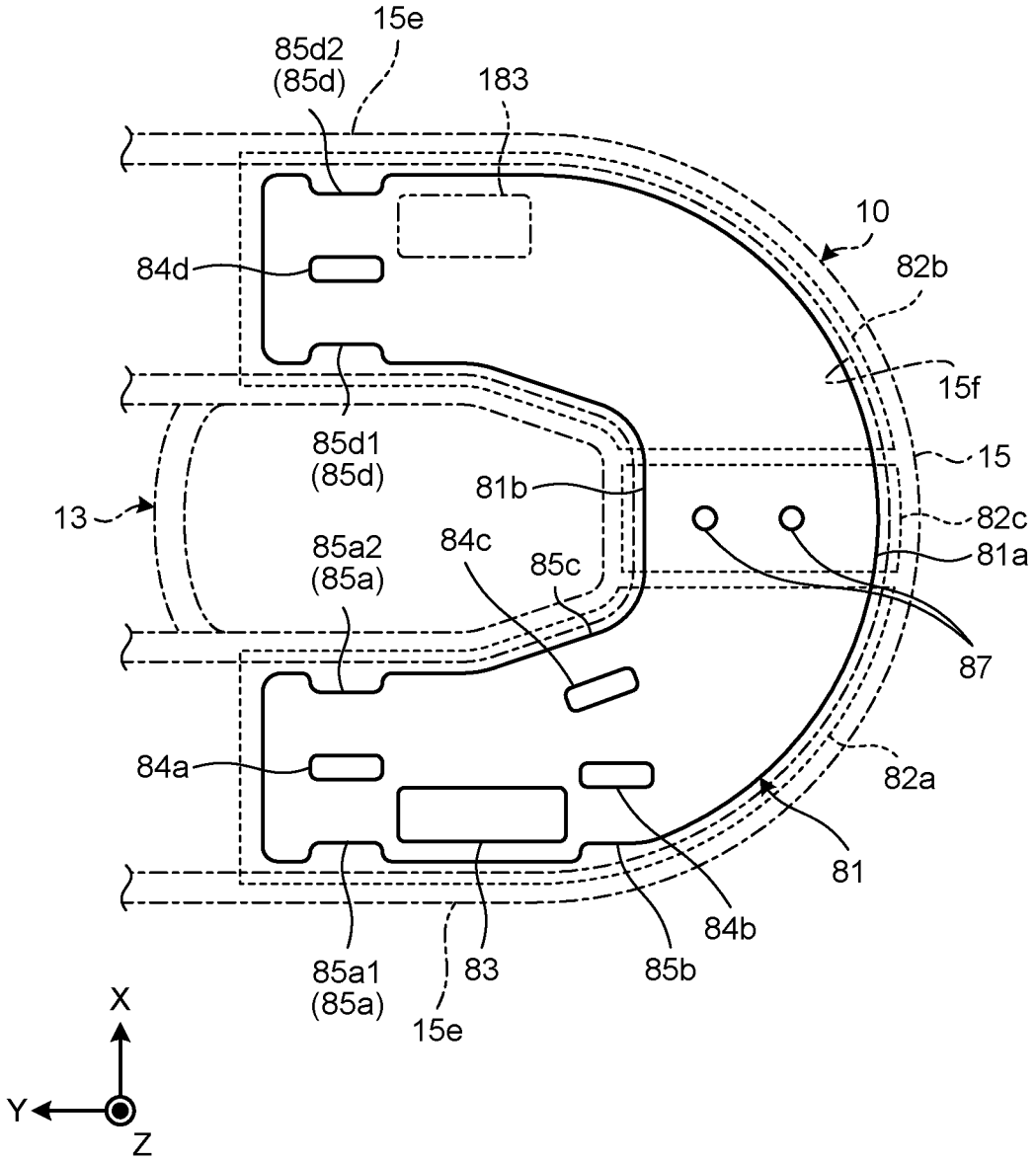
FIG. 5 is a plan view of a bracket.

FIG. 5 is a plan view of the bracket 81 in a state where it is installed in the toilet 10. In FIG. 5, for convenience of understanding, an outline of the toilet 10 is represented with dashed-dotted lines and illustration of a member such as the valve 60 or the connection terminal 72 is omitted.

As illustrated in FIG. 3 and FIG. 5, the bracket 81 (represented with a dashed-dotted line in FIG. 3) is formed into a plate shape or a substantially plate shape.

In FIG. 3, for simplification of illustration, the valve 60 is represented with a dashed-dotted line and illustration of the connection terminal 72 or the like is omitted. In FIG. 5, for facilitating an explanation, in the bracket 81, a site to be mounted with a water supplying system that includes the valve 60 is a "water supplying system mounting site 82*a*" and a site to be mounted with an electric power supplying system that includes the connection terminal 72 is an "electric power supplying system mounting site 82*b*", where each of them is surrounded by, and represented with, a dashed line. In the bracket 81, a site to be installed in the toilet 10 is an "installed site 82*c*" as described below, and is similarly surrounded by, and represented with, a broken line.

As illustrated in FIG. 5, the bracket 81 is formed into a substantially U-shape in a plan view and located between the skirt part 15 of the toilet 10 and the drain trap pipeline 13. In the bracket 81, in a case where a site that is opposite to the skirt part 15 of the toilet 10 is an outer periphery 81*a* and a site that is opposite to the drain trap pipeline 13 is an inner periphery 81*b*, a shape of the outer periphery 81*a* is a shape suitable for an inner wall 15*f* of the skirt part 15. A shape of the inner periphery 81*b* of the bracket 81 is a shape suitable for an outline of the drain trap pipeline 13.

Thereby, in a state where the bracket 81 is installed in the toilet 10, it is possible to cause gaps between the bracket 81 and the skirt part 15 and between the bracket 81 and the drain trap pipeline 13 to be difficult to be produced. Accordingly, for example, the first or second water supplying pipe 61*a* or 61*b*, the first or second electric power supply cord 71*a* or 71*b*, or the like mounted on the bracket 81 can be prevented from falling from the bracket 81 or being inserted into a gap between the bracket 81 and the skirt part 15 or the like.

The bracket 81 includes an exposure part 83, first to third insertion holes 84*a* to 84*c*, and first to third locking parts 85*a* to 85*c*, on the water supplying system mounting site 82*a*. The first to third insertion holes 84*a* to 84*c* and the first to third locking parts 85*a* to 85*c* are examples of a mounting part for constraint member.

The exposure part 83 is an opening with a rectangular shape or a substantially rectangular shape in a plan view. Namely, the bracket 81 has an opening that is configured such that the switching part can be accessed from below. The exposure part 83 is formed along the outer periphery 81*a* on the bracket 81. In other words, the exposure part 83 is formed at a position closer to a side of the skirt part 15, in detail, a position closer to the inner wall 15*f* of the side face part 15*e* of the skirt part 15, on the bracket 81 in a state where it is installed in the toilet 10. The exposure part 83 is mounted with the valve 60 as described below and exposes the valve 60 to a downside (see FIG. 6B).

A shape of the exposure part 83 is not limited to the above-mentioned rectangular shape or substantially rectangular shape, and may be another shape such as a circular shape or an elliptical shape as long as the valve 60 can be exposed to a downside. The exposure part 83 is not necessarily needed to be an opening and may be, for example, a notch provided by notching the outer periphery 81*a*.

Each of the first to third insertion holes 84*a* to 84*c* is an opening for inserting and mounting the constraint member 91. The first insertion hole 84*a* is formed on a side of a positive direction of a Y-axis on the water supplying system mounting site 82*a*, in other words, an end thereof on a side of the wall W. The first insertion hole 84*a* and the second insertion hole 84*b* are formed in a neighborhood of the exposure part 83 (for example, an opening) and formed at positions where the exposure part 83 is interposed therebetween in a plan view. As can be seen from FIG. 4 or the like, the two constraint members 91 are inserted through the first insertion hole 84*a*. The third insertion hole 84*c* is formed at a position displaced toward a side of the inner periphery 81*b* relative to the second insertion hole 84*b*.

Each of the first to third locking parts 85*a* to 85*c* is a site where the constraint member 91 is locked and mounted. The first locking part 85*a* includes an outer periphery side first locking part 85*a*1 that is formed at a position corresponding to the first insertion hole 84*a* on the outer periphery 81*a*, and an inner periphery side first locking part 85*a*2 that is formed at a position corresponding to the first insertion hole 84*a* on the inner periphery 81*b*.

The second locking part 85*b* is formed at a position corresponding to the second insertion hole 84*b* on the outer periphery 81*a* and the third locking part 85*c* is formed at a position corresponding to the third insertion hole 84*c* on the inner periphery 81*b*.

The outer periphery side first locking part 85*a*1 and the second locking part 85*b* are formed in a neighborhood of the exposure part 83 (for example, an opening) similarly to the first and second insertion holes 84*a* and 84*b* and formed at positions where the exposure part 83 is interposed therebetween in a plan view.

The outer periphery side first locking part 85*a*1 and the second locking part 85*b* have notch shapes provided by notching a part of the outer periphery 81*a* of the bracket 81 and the inner periphery side first locking part 85*a*2 has a notch shape provided by notching a part of the inner periphery 81*b* of the bracket 81.

Figure 6A:
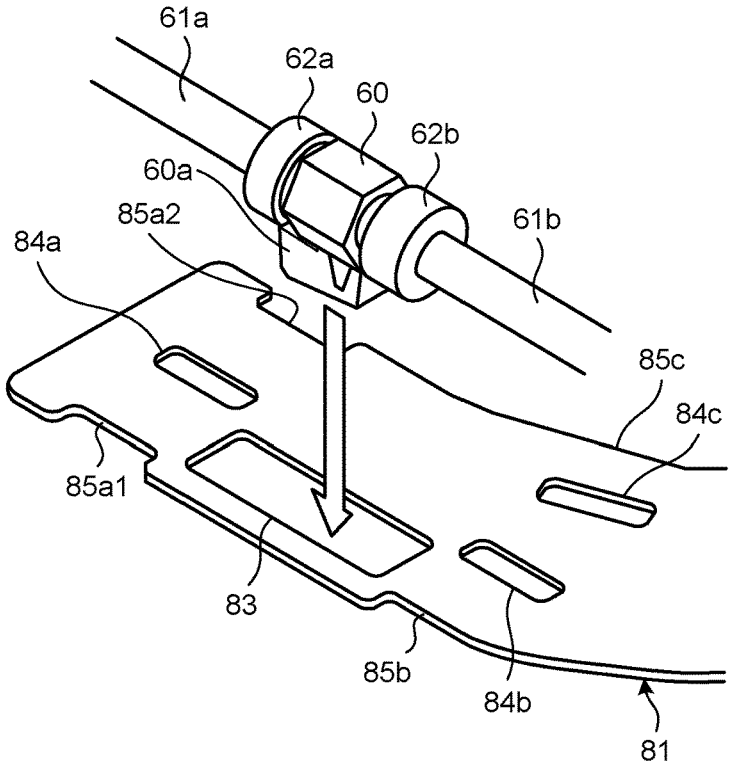
FIG. 6A is a diagram illustrating mounting of a valve or the like on a bracket.
Figure 6B:
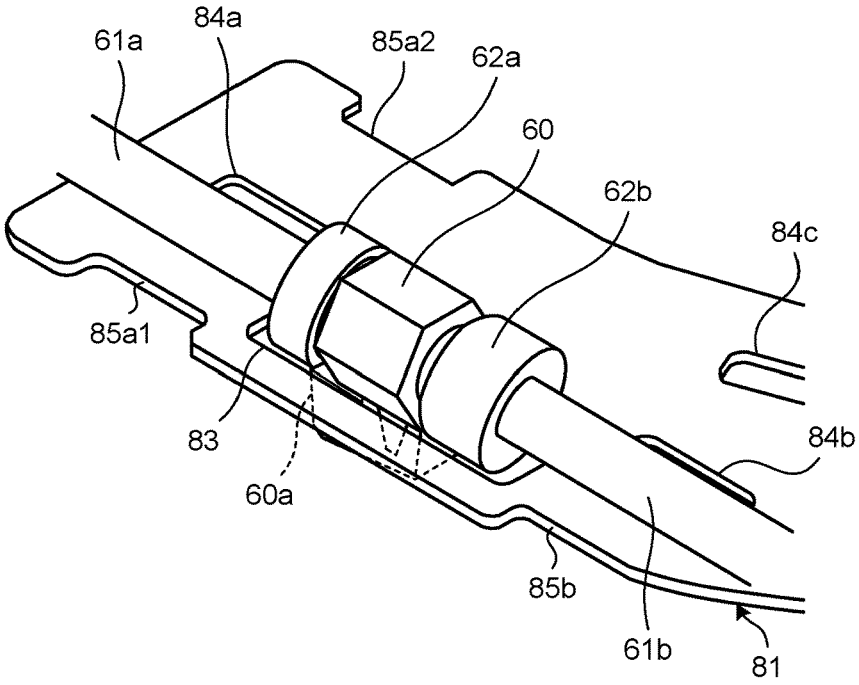
FIG. 6B is a diagram illustrating mounting of a valve or the like on a bracket.
Figure 6C:
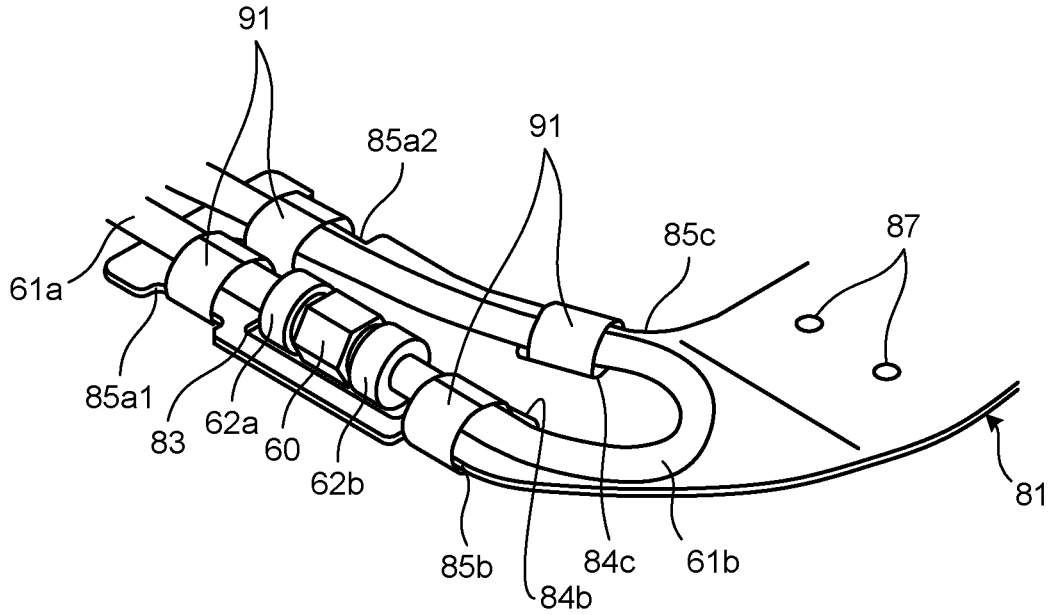
FIG. 6C is a diagram illustrating mounting of a valve or the like on a bracket.

Herein, mounting of the valve 60 or the first or second water supplying pipe 61*a* or 61*b* on the bracket 81 will be described with reference to FIG. 6A to FIG. 6C. FIG. 6A to FIG. 6C are diagrams illustrating mounting of the valve 60 or the like on the bracket 81.

As illustrated in FIG. 6A, the valve 60 is located above the exposure part 83 of the bracket 81. Herein, the valve 60 is located in such a manner that the operation part 60*a* is provided on a downside. Subsequently, as illustrated in FIG. 6B, the valve 60 is mounted on the exposure part 83, and the first water supplying pipe 61*a* is mounted between the first insertion hole 84*a* and the outer periphery side first locking part 85*a*1, while the second water supplying pipe 61*b* is mounted between the second insertion hole 84*b* and the second locking part 85*b*. Thereby, the operation part 60*a* of the valve 60 is exposed to a downside through the exposure part 83.

Then, as illustrated in FIG. 6C, the second water supplying pipe 61*b* is curved so as to U-turn on the bracket 81 and mounted so as to pass between the third insertion hole 84*c* and the third locking part 85*c* and between the first insertion hole 84*a* and the inner periphery side first locking part 85*a*2

(not illustrated in FIG. 6C). The second water supplying pipe 61*b* is curved to have a predetermined curved shape and this will be described later.

Subsequently, the first water supplying pipe 61*a* or the like mounted on the bracket 81 as described above is constrained on the bracket 81 by using the constraint member 91. Specifically, the constraint member 91 inserted through the first insertion hole 84*a* is locked on the outer periphery side first locking part 85*a*1 and is caused to wind around the bracket 81, so that the first water supplying pipe 61*a* is constrained on the bracket 81.

Similarly, the constraint member 91 inserted through the second insertion hole 84*b* is locked on the second locking part 85*b* and caused to wind around the bracket 81, so that the second water supplying pipe 61*b* is constrained on the bracket 81. The constraint member 91 inserted through the third insertion hole 84*c* is locked on the third locking part 85*c* and caused to wind around the bracket 81 and the constraint member 91 inserted through the first insertion hole 84*a* is locked on the inner periphery side first locking part 85*a*2 and caused to wind around the bracket 81, so that the second water supplying pipe 61*b* is constrained on the bracket 81.

Thus, in a state where the valve 60 is mounted on the exposure part 83, the first and second water supplying pipes 61*a* and 61*b* at both ends of the valve 60 are constrained on the bracket 81. Because the exposure part 83 is formed at a position closer to a side of the skirt part of the bracket 81 as described above, the valve 60 is positioned and fixed at a position closer to a side of the skirt part 15, in detail, a position closer to the inner wall 15*f* of the side face part 15*e* of the skirt part 15 (see FIG. 4).

Thereby, the valve 60 is disposed adjacent to a side of a user that executes a manual operation, as compared with, for example, a case where it is disposed at a position closer to a side of the drain trap pipeline 13. Accordingly, it is possible for a user to manually operate the valve 60 readily when his or her hand is put in a side of the lower end 15*a* of the skirt part 15, and hence, switching between water supplying and water stopping for the sanitary washing device 30 can be executed more readily.

Because the first and second insertion holes 84*a* and 84*b*, the outer periphery side first locking parts 85*a*1, and the second locking part 85*b* are formed in a neighborhood of the exposure part 83 as described above, the valve 60 can tightly be fixed on the bracket 81 so that positional displacement of the valve 60 can be suppressed.

That is, because the first and second insertion holes 84*a* and 84*b* or the like are formed at a position where the exposure part 83 is interposed therebeteween in a plan view, both end sides of the valve 60 mounted on the exposure part 83 are constrained by the constraint members 91. Thereby, the valve 60 is tightly fixed on the bracket 81, and hence, for example, in a case where a manual operation is executed so that force acts thereon, occurrence of positional displacement of the valve 60 can be suppressed. In this specification, a "neighborhood of the exposure part 83" with the first or second insertion hole 84*a* or 84*b* or the like being formed therein means, for example, a range with constraint force of the constraint member 91 being applied to the valve 60 mounted on the exposure part 83 therein.

Because the outer periphery side first locking part 85*a*1, the inner periphery side first locking part 85*a*2, and the second locking part 85*b* have notch shapes as described above, for example, positional displacement of the constraint member 91 can be suppressed.

That is, for example, as the valve 60 is manually operated or the sanitary washing device 30 is mounted on the toilet 10, force in a direction of displacement of the constraint member 91 may act on the constraint member 91. Even in such a case, because the constraint member 91 is caught by the outer periphery side first locking part 85*a*1 with a notch shape or the like, positional displacement of the constraint member 91 can be suppressed.

Because force in a direction of displacement of the constraint member 91 is difficult to act on the constraint member 91 mounted on the third locking part 85*c* even in a case where the valve 60 is manually operated, the third locking part 85*c* does not have a notch shape and is not limited thereto but may have a notch shape.

Next, a "predetermined curved shape" that is a shape of the second water supplying pipe 61*b* on the bracket 81 will be described with reference to FIG. 4. A predetermined curved shape is, for example, a curved shape that has a radius greater than or equal to a minimum bending radius R1 of the second water supplying pipe 61*b*, as represented with a broken line in FIG. 4. Herein, the minimum bending radius R1 means a minimum value of a bending radius that is difficult to produce a kink such as a break or a twist on the second water supplying pipe 61*b*.

The second water supplying pipe 61*b* is curved so as to have the above-mentioned predetermined curved shape, mounted on the bracket 81, and subsequently constrained on the bracket 81 by the constraint member 91. The above-mentioned second and third insertion holes 84*b* and 84*c* and second and third locking parts 85*b* and 85*c* (mounting parts for constraint member) are formed at positions on the bracket 81 where the second water supplying pipe 61*b* (extending member) is constrained while a predetermined curved shape thereof is maintained. Namely, the second and third insertion holes 84*b* and 84*c* and the second and third locking parts 85*b* and 85*c* constrain the second water supplying pipe 61*b* such that the second water supplying pipe 61*b* has a predetermined curved shape. Thereby, the minimum bending radius R1 of the second water supplying pipe 61*b* can be ensured, and hence, production of a kink can be prevented.

Next, the electric power supplying system mounting site 82*b* of the bracket 81 will be described with reference to FIG. 5. As illustrated in FIG. 5, the bracket 81 includes a fourth insertion hole 84*d* and a fourth locking part 85*d* in the electric power supplying system mounting site 82*b*. The fourth insertion hole 84*d* and the fourth locking part 85*d* are examples of a mounting part for constraint member.

The fourth insertion hole 84*d* is an opening for inserting and mounting the constraint member 92. The fourth insertion hole 84*d* is formed at an end on a side of a positive direction of a Y-axis, in other words, a side of the wall W, in the electric power supplying system mounting site 82*b*. As can be seen from FIG. 4 or the like, the two constraint members 92 are inserted through the fourth insertion hole 84*d*.

The fourth locking part 85*d* is a site where the constraint member 92 is locked and mounted. The fourth locking part 85*d* includes an inner periphery side fourth locking part 85*d*1 that is formed at a position corresponding to the fourth insertion hole 84*d* in the inner periphery 81*b*, and an outer periphery side fourth locking part 85*d*2 that is formed at a position corresponding to the fourth insertion hole 84*d* in the outer periphery 81*a*.

The inner periphery side fourth locking part 85*d*1 has a notch shape provided by notching a part of the inner periphery 81*b* of the bracket 81, and the outer periphery side fourth locking part 85*d*2 has a notch shape provided by notching a part of the outer periphery 81*a* of the bracket 81.

The outer periphery side fourth locking part 85*d*2 is formed along the outer periphery 81*a* on the bracket 81. In other words, the outer periphery side fourth locking part 85*d*2 is formed at a position closet to a side of the skirt part 15, in detail, a position closer to the inner wall 15*f* of the side face part 15*e* of the skirt part 15, on the bracket 81 in a state where it is installed in the toilet 10.

Figure 7A:
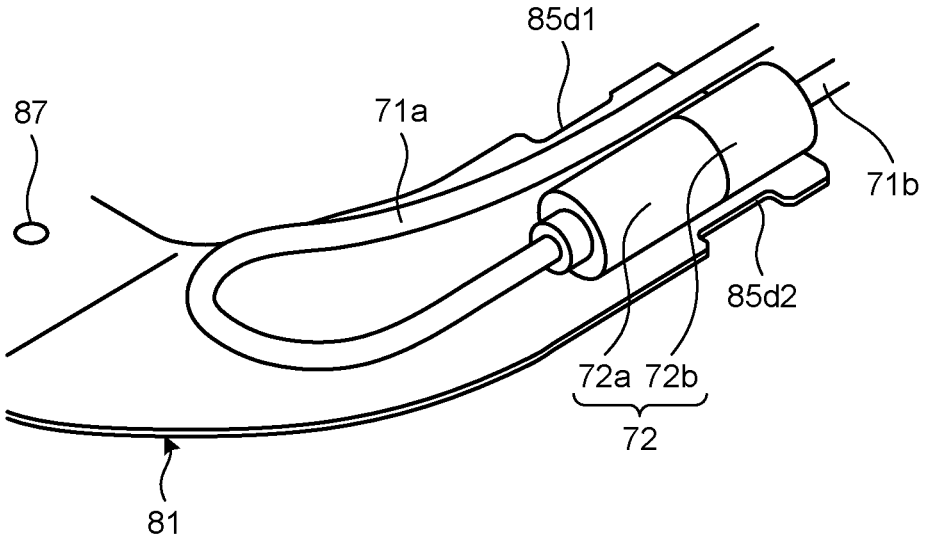
FIG. 7A is a diagram illustrating mounting of a connection terminal or the like on a bracket.
Figure 7B:
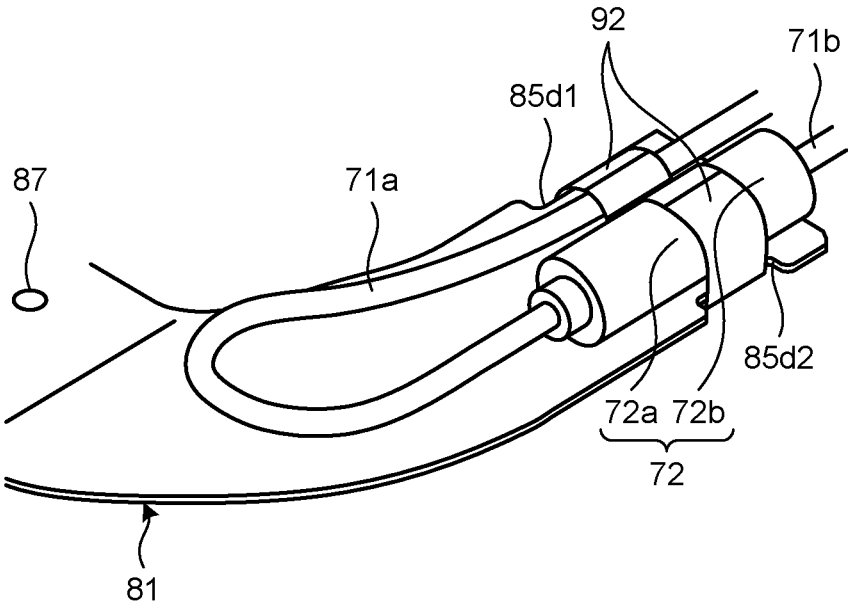
FIG. 7B is a diagram illustrating mounting of a connection terminal or the like on a bracket.

Herein, mounting of the connection terminal 72 or the second electric power supply cord 71*a* or 71*b* on the bracket 81 will be described with reference to FIG. 7A and FIG. 7B. FIG. 7A and FIG. 7B are diagrams illustrating mounting of the connection terminal 72 or the like on the bracket 81.

As illustrated in FIG. 7A, the first electric power supply cord 71*a* is mounted between the fourth insertion hole 84*d* (not illustrated in FIG. 7A) and the inner periphery side fourth locking part 85*d*1 and curved into a predetermined curved shape on the bracket 81. A predetermined curved shape of the first electric power supply cord 71*a* will be described later.

The connection terminal 72 is mounted between the fourth insertion hole 84*d* and the outer periphery side fourth locking part 85*d*2. Subsequently, as illustrated in FIG. 7B, the first electric power supply cord 71*a* or the like mounted on the bracket 81 is constrained on the bracket 81 by using the constraint member 92. Specifically, the constraint member 92 inserted through the fourth insertion hole 84*d* is locked on the inner periphery side fourth locking part 85*d*1 and caused to wind on the bracket 81, so that the first electric power supply cord 71*a* is constrained on the bracket 81.

The constraint member 92 inserted through the fourth insertion hole 84*d* is locked on the outer periphery side fourth locking part 85*d*2 and caused to wind on the bracket 81, so that the connection terminal 72 is constrained on the bracket 81. Thereby, positional displacement of the connection terminal 72 relative to the bracket 81 can be suppressed effectively.

As described above, the outer periphery side fourth locking part 85*d*2 is formed at a position closer to a side of the skirt part 15 on the bracket 81. Because the connection terminal 72 is constrained between the outer periphery side fourth locking part 85*d*2 and the fourth insertion hole 84*d*, it is positioned and fixed at a position closer to a side of the skirt part 15, in detail, a position closer to the inner wall 15*f* of the side face part 15*e* of the skirt part 15 (see FIG. 4).

Thereby, the connection terminal 72 is disposed adjacent to a side of a user that executes a manual operation, as compared with, for example, a case where it is disposed at a position closer to a side of the drain trap pipeline 13. Accordingly, it is possible for a user to manually operate the connection terminal 72 readily when his or her hand is put in a side of the lower end 15*a* of the skirt part 15, and hence, switching between electric power supplying and electric power supply stopping for the sanitary washing device 30 can be executed more readily.

Because the inner periphery aide fourth locking part 85*d*1 and the outer periphery side fourth locking part 85*d*2 have notch shapes as describe above, for example, positional displacement of the constraint member 92 can be suppressed.

That is, for example, as the connection terminal 72 is manually operated or the sanitary washing device 30 is mounted on the toilet 10, force in a direction of displacement of the constraint member 92 may act on the constraint member 92. Even in such a case, because the constraint member 92 is caught by the inner periphery side fourth locking part 85*d*1 with a notch shape or the like, positional displacement of the constraint member 92 can be suppressed.

Next, a "predetermined curved shape" that is a shape of the first electric power supply cord 71*a* on the bracket 81 will be described with reference to FIG. 4. A predetermined curved shape of the first electric power supply cord 71*a* is, for example, a curved shape that has a radius greater than or equal to a minimum bending radius R2 of the first electric power supply cord 71*a*, as represented with a broken line in FIG. 4. Herein, the minimum bending radius R2 means a minimum value of a bending radius that is difficult to produce a kink of the first electric power supply cord 71*a*.

The first electric power supply cord 71*a* is curved so as to have the above-mentioned predetermined curved shape, mounted on the bracket 81, and constrained on the bracket 81 by the constraint member 92. That is, the above-mentioned fourth insertion hole 84*d* and fourth locking part 85*d* (mounting parts for constraint member) are formed at positions on the bracket 81 where the first electric power supply cord 71*a* (extending member) is constrained while a predetermined curved shape thereof is maintained. Namely, the fourth insertion hole 84*d* and the fourth locking part 85*d* constrain the first electric power supply cord 71*a* such that the first electric power supply cord 71*a* has a predetermined curved shape. Thereby, the minimum bending radius R2 of the first electric power supply cord 71*a* can be ensured, and hence, production of a kink can be prevented.

Positions or numbers of the exposure part 83, the first to fourth insertion holes 84*a* to 84*d*, and the first to fourth locking parts 85*a* to 85*d* on the bracket 81 as illustrated in FIG. 5 are merely illustrative and not limiting, and are changeable appropriately.

As illustrated in FIG. 5, the bracket 81 includes a plurality of (for example, two) screw insertion holes 87 on the installed site 82*c*. A mounting screw 95 (see FIG. 11) is inserted through the screw insertion hole 87, and this will be described later.

Next, a configuration of the toilet 10 with the above-mentioned bracket 81 being installed therein will be described in more detail. As illustrated in FIG. 3, the toilet 10 includes a mounting part for bracket 18. The mounting part for bracket 18 is formed so as to continuously connect the drain trap pipeline 13 and the inner wall 15*f* on a side of the front face part 15*c* of the skirt part 15 in the internal space A of the skirt part 15.

A female screw hole 19 is formed on the mounting part for bracket 18 at a position corresponding to the above-mentioned screw insertion hole 87 (where illustration thereof is omitted in FIG. 3) of the bracket 81. Therefore, the mounting screw 95 (see FIG. 11) is fastened in the female screw hole 19 through the screw insertion hole 87 of the bracket 81, so that the bracket 81 is mounted on a bottom face 18*a* of the mounting part for bracket 18.

For example, a not-illustrated rubber bush may be installed in the female screw hole 19. Thereby, interference between the mounting part for bracket 18 and the bracket 81 can be mitigated.

It is preferable for a height H2 of the bottom face 18*a* of the mounting part for bracket 18 from the floor face F to be set so as to be, for example, a predetermined height H3 higher than the height H1 of the lower end 15*a* of the skirt part 15 of the toilet 10. Thereby, the bracket 81 is located in a space at the predetermined height H3 in the internal space A of the skirt part 15.

As described above, a gap with the height H1 with a user being able to put his or her hand therein is provided between the lower end 15*a* of the skirt part 15 and the floor face F. Therefore, the valve 60 or the connection terminal 72 (not illustrated in FIG. 3) mounted on the bracket 81 is positioned and fixed at a manually operable position inside the skirt part 15. Specifically, the valve 60 or the like mounted on the bracket 81 is positioned and fixed at a height in a neighborhood of the lower end 15*a* of the skirt part 15. Namely, the fixation member 80 fixes the switching part at a height in a neighborhood of the lower end 15*a* of the skirt part 15.

Thereby, it is possible for a user to put his or her hand in the lower end 15*a* of the skirt part 15, for example, in an event of emergency, to manually operate the valve 60 or the connection terminal 72 readily, and switching between water supplying and water stopping or switching between electric power supplying and electric power supply stopping, for the sanitary washing device 30, can readily be executed. In this specification, a "height in a neighborhood of the lower end 15*a* of the skirt part 15" with the valve 60 or the connection terminal 72 being disposed thereat means, for example, a range that is reached by a hand of a user that is put in a side of the lower end 15*a* of the toilet 10.

As described above, the operation part 60*a* of the valve 60 is exposed to a downside trough the exposure part 83 of the bracket 81 (see FIG. 6B). Thereby, a user can readily access and manually operate the valve 60 on a side of the lower end 15*a* of the toilet 10, and can more readily execute switching between water supplying and water stopping for the sanitary washing device 30.

Because the bracket 81 is hidden by and housed inside the skirt part 15, the bracket 81, a water supplying system, or an electric power supplying system cannot apparently be viewed, and hence, a design of the toilet apparatus 1 can be improved.

For example, in a state where the toilet 10 is mounted on the wall W, it is preferable for the bottom face 18*a* of the mounting part for bracket 18 to be formed so as to be parallel or substantially parallel to the floor face F, in other words, to be formed so as to be horizontal or substantially horizontal. Thereby, because the bracket 81 mounted on the mounting part for bracket 18 is also horizontal or substantially horizontal, the first water supplying pipe 61*a*, the first electric power supply cord 71*a*, or the like mounted on the bracket 81 can be prevented from slipping off the bracket 81.

In FIG. 2, the bottom face 18*a* of the mounting part for bracket 18 is represented with broken lines. As illustrated in FIG. 2, the bottom face 18*a* of the mounting part for bracket 18 is formed in such a manner that a width thereof in a direction of an X-axis is less than or equal to a width of the water storage part 13*b* of the drain trap pipeline 13. Thereby, a volume of the internal space A that can sufficiently house a water supplying system that includes the first water supplying pipe 61*a* or the like and an electric power supplying system that includes the first electric power supply cord 71*a* or the like can be ensured on sides of the mounting part for bracket 18.

As the description of the toilet 10 is continued, the toilet 10 includes a leading hole 20 as illustrated in FIG. 2. The leading hole 20 is formed adjacent to a side of the wall W of the top face 17*b* of the rim part 17, and is a hole for leading, in the internal space A of the toilet 10, the second water supplying pipe 61*b* or the second electric power supply cord 71*b* that are connected to the sanitary washing device 30, as the sanitary washing device 30 is mounted on the toilet 10.

Figure 8:
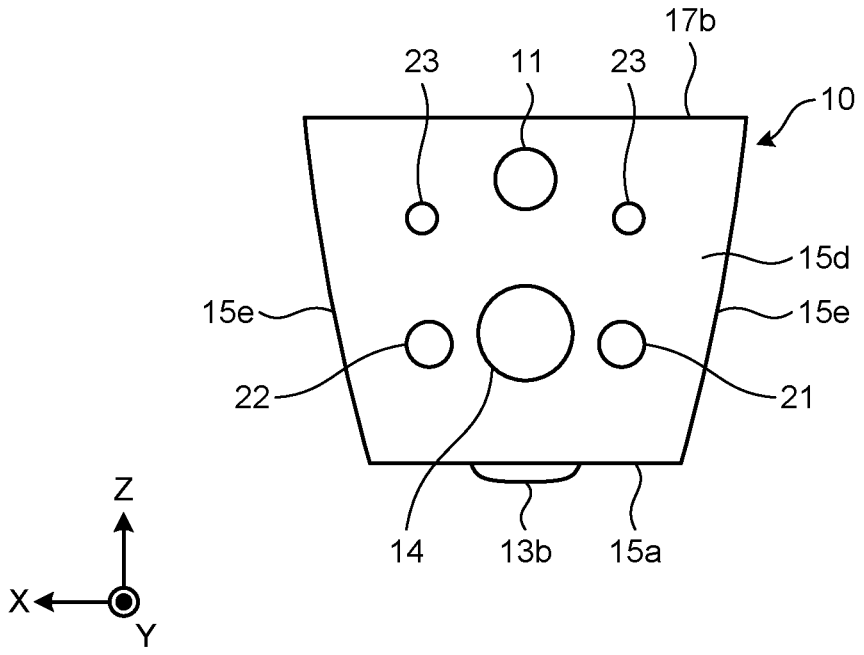
FIG. 8 is a diagram of a toilet when viewed from a side of a back face part of a skirt part.

FIG. 8 is a diagram of the toilet 10 when viewed from a side of the back face part 15*d* of the skirt part 15. As illustrated in FIG. 8, the back face part 15*d* is provided with an inlet of the above-mentioned headrace channel 11 or an outlet of the above-mentioned drainage channel 14. A leading hole for water supplying 21, a leading hole for electric power supplying 22, and two mounting holes 23 are also formed on the back face part 15*d*.

The leading hole for water supplying 21 is formed adjacent to the drainage channel 14 on the back face part 15*d* and is a hole for leading the first water supplying pipe 61*a* that extends from the wall W in the internal space A of the toilet 10 as the toilet 10 is mounted on the wall W.

The leading hole for electric power supplying 22 is formed at a position on an opposite side of the leading hole for water supplying 21 with respect to the drainage channel 14 on the back face part 15*d*. The leading hole for electric power supplying 22 is a hole for leading the first electric power supply cord 71*a* that extends from the wall W in the internal space A of the toilet 10 as the toilet 10 is mounted on the wall W. The mounting hole 23 is a hole for inserting a bolt for mounting 75 (see FIG. 9A) that protrudes from the wall W.

Figure 9A:
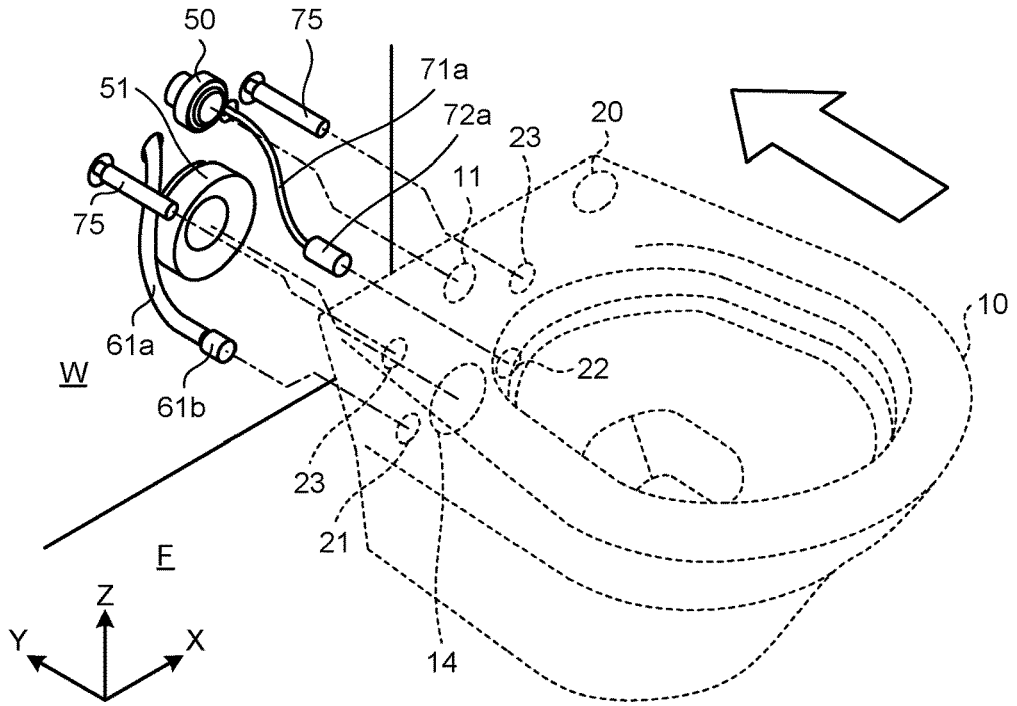
FIG. 9A is a perspective view illustrating a state before a toilet is mounted on a wall.
Figure 9B:
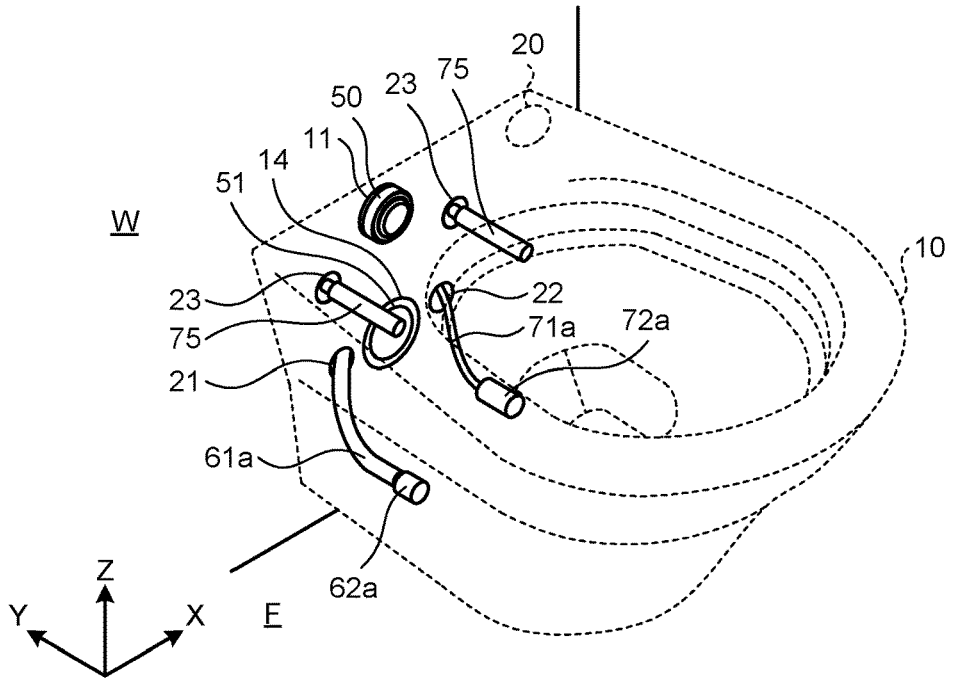
FIG. 9B is a perspective view illustrating a state after a toilet is mounted on a wall.

Next, assembly (installation) of the toilet apparatus 1 will be described with reference to FIG. 9A and subsequent drawings. FIG. 9A is a perspective view illustrating a state before the toilet 10 is mounted on the wall W, and FIG. 9B is a perspective view illustrating a state after the toilet 10 is mounted on the wall W. In FIG. 9A and FIG. 9B, the toilet 10 is represented with broken lines for convenience of understanding.

As illustrated in FIG. 9A, the washing water supplying pipe 50, the drain pipe 51, the first water supplying pipe 61*a*, the first electric power supply cord 71*a*, and the two bolts for mounting 75 are provided on the wall W before the toilet 10 is mounted thereon.

The toilet 10 is moved in a positive direction of a Y-axis and the back face part 15*d* contacts the wall W. Thereby, as illustrated in FIG. 9B, the bolt for mounting 75 is inserted through the mounting hole 23 and the bolt for mounting 75 is fastened and fixed by a not-illustrated nut, so that the toilet 10 is mounted on the wall W.

The washing water supplying pipe 50 is connected to the headrace channel 11 and the drain pipe 51 is connected to the drainage channel 14. The first water supplying pipe 61*a* is led in the toilet 10 through the leading hole for water supplying 21 and the first electric power supply cord 71*a* is led in the toilet 10 through the leading hole for electric power supplying 22.

Figure 10:
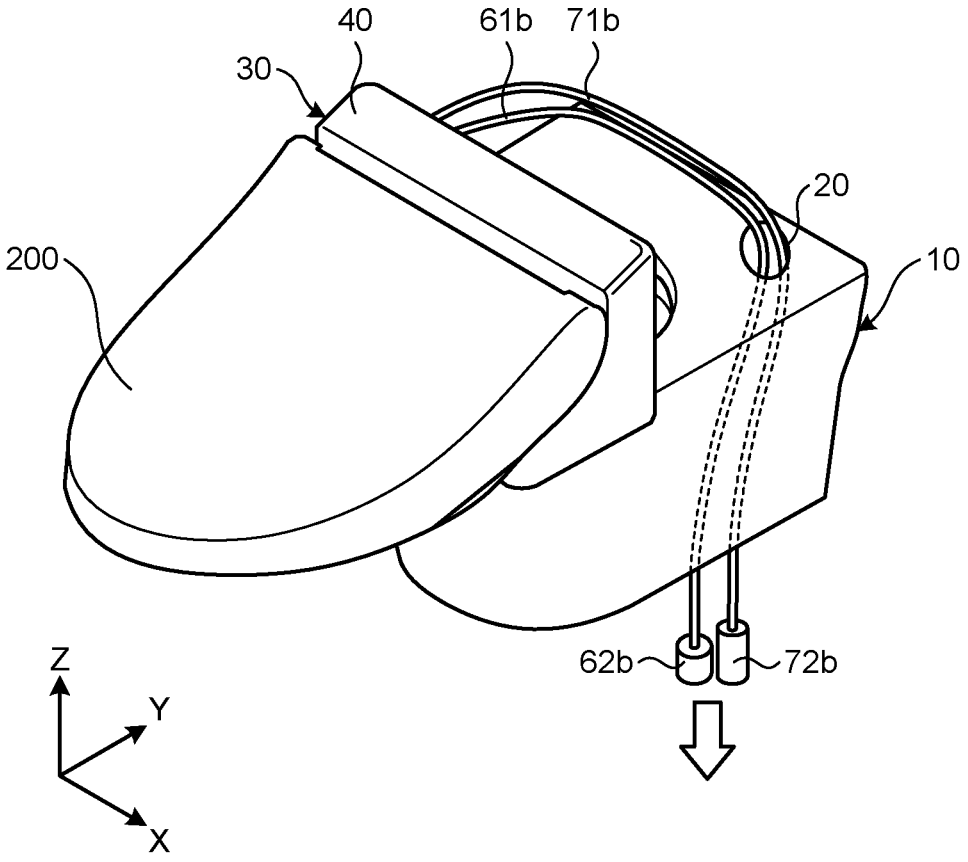
FIG. 10 is a perspective view illustrating a situation where a sanitary washing device is mounted on a toilet.

Subsequently, the sanitary washing device 30 is mounted on the toilet 10. FIG. 10 is a perspective view illustrating a situation that the sanitary washing device 30 is mounted on the toilet 10. As illustrated in FIG. 10, as the sanitary washing device 30 is mounted on the toilet 10, the second water supplying pipe 61*b* and the second electric power supply cord 71*b* are led in an interior of the toilet 10 through the leading hole 20.

Subsequently, the first water supplying pipe 61*a* and the second water supplying pipe 61*b* that have been led in an interior of the toilet 10 are connected to one another through the valve 60, and the first electric power supply cord 71*a* and the second electric power supply cord 71*b* are connected to one another through the first and second connection terminals 72*a* and 72*b*. Subsequently, the valve 60 or the like is mounted and fixed on the bracket 81 as described above (see FIG. 4).

Figure 11:
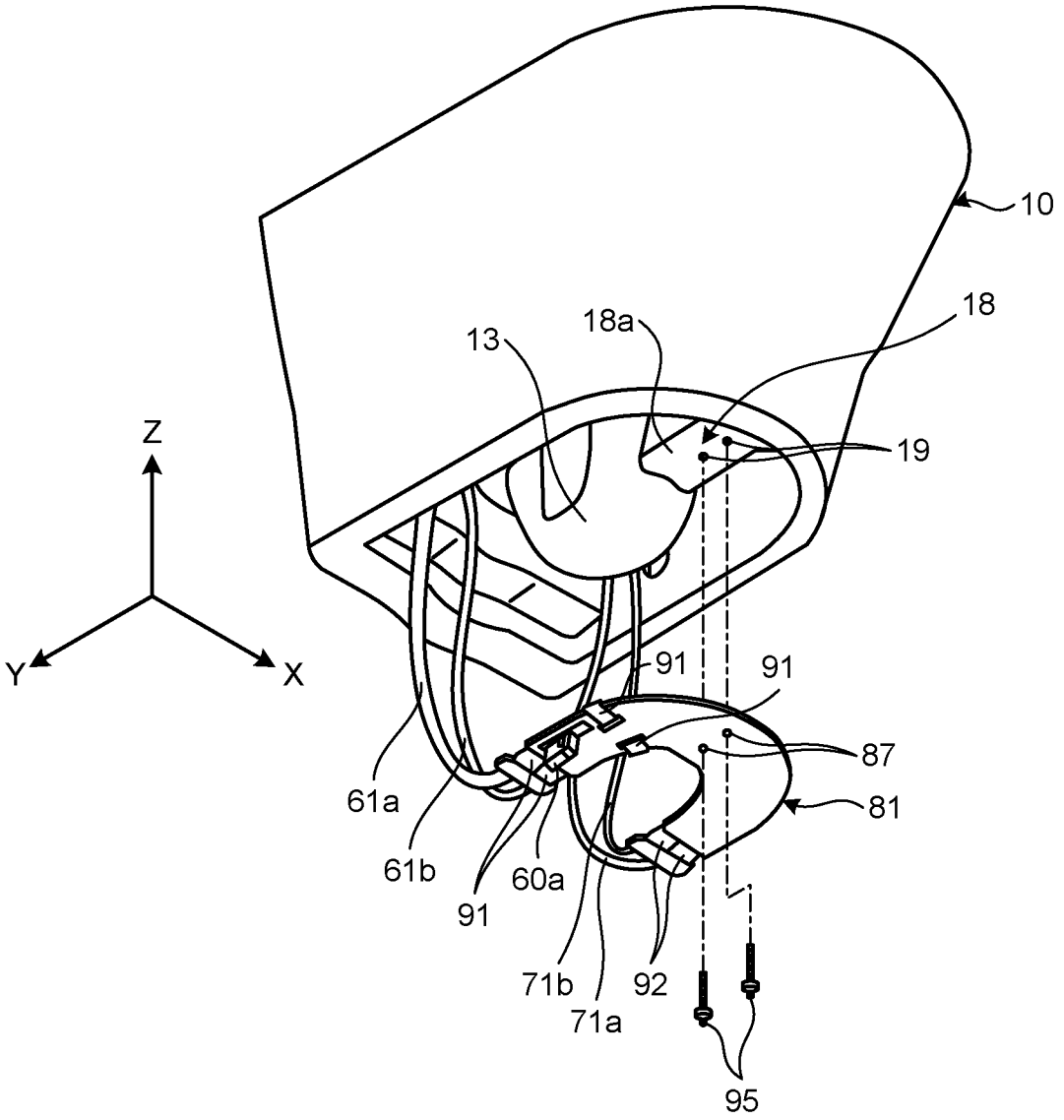
FIG. 11 is a perspective view of a situation where a bracket is installed in a toilet when viewed from an obliquely downward side.

Subsequently, the bracket 81 with the valve 60 or the like fixed thereon is mounted on the mounting part for bracket 18 of the toilet 10. FIG. 11 is a perspective view of a situation that the bracket 81 is installed in the toilet 10 when viewed obliquely from underneath.

As illustrated in FIG. 11, the mounting screw 95 is inserted through the screw insertion hole 87 of the bracket 81 and subsequently fastened in the female screw hole 19, so that the bracket 81 is mounted on the mounting part for bracket 18. Thereby, assembly of the toilet apparatus 1 is completed.

As has been described above, the toilet apparatus 11 according to the first embodiment includes the wall-mounted-type toilet 10, the sanitary washing device 30, the valve 60, the connection terminal 72, and the fixation member 80. The toilet 10 includes the skirt part 15 that covers the bowl part 12 that receives sewage and forms an outline of a toilet bowl. The sanitary washing device 30 is provided on a top face of the toilet 10 and washes a private part of a user. The valve 60 switches between water supplying and water stopping for the sanitary washing device 30, by a manual operation. The connection terminal 72 switches between electric power supplying and electric power supply stopping for the sanitary washing device 30, by a manual operation. The fixation member 80 positions and fixes the valve 60 or the connection terminal 72 at a manually operable position inside the skirt part 15. Namely, the fixation member 80 fixes the switching part at a position inside the skirt part 15, where the switching part is manually operable at the position. Thereby, switching between water supplying and water stopping or switching between electric power supplying and electric power supply stopping, for the sanitary washing device 30, can readily be executed.

The fixation member 80 includes the bracket 81 that is installed in the toilet 10, and the constraint member 91 or 92 that constrains the first water supplying pipe 61*a* that extends from the valve 60 or the first electric power supply cord 71*a* that extends from the connection terminal 72 on the bracket 81 to fix the valve 60 or the connection terminal 72 thereon. Thereby, the valve 60 or the connection terminal 72 can be positioned and fixed by a simple configuration.

The toilet apparatus 1 includes a valve that switches between water supplying and water stopping for the sanitary washing device 30 and a connection terminal that switches between electric power supplying and electric power supply stopping for the sanitary washing device 30, as switching parts. Thereby, switching between water supplying and water stopping for the sanitary washing device 30 or switching between electric power supplying and electric power supply stopping can readily be executed by a simple configuration.

Second Embodiment

Next, a second embodiment will be described. In the following descriptions, a part similar to the part having already been described will be provided with a reference symbol identical to that of the part having already been described, and redundant descriptions thereof will be omitted.

Figure 12:
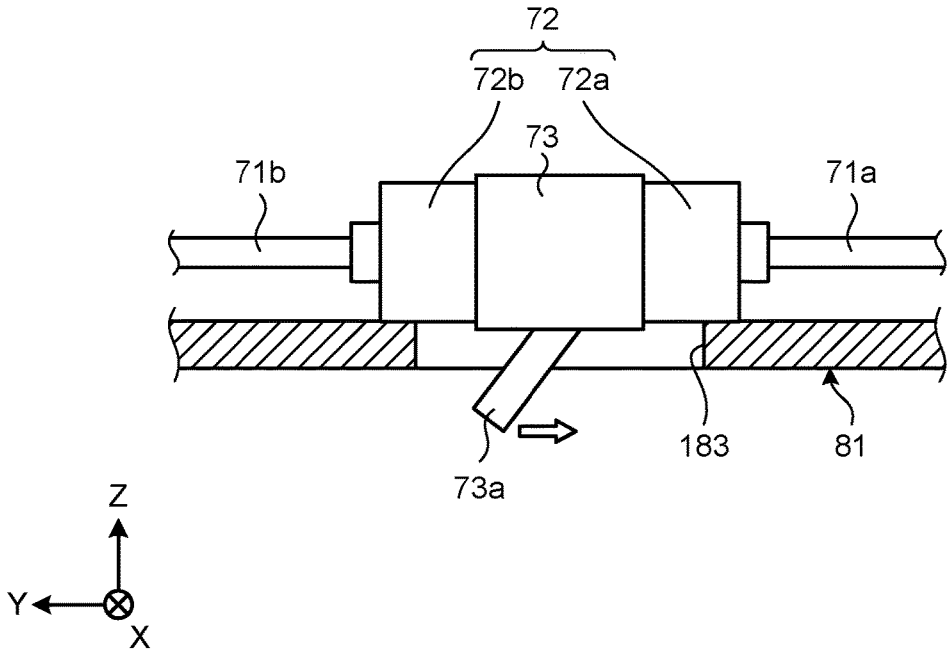
FIG. 12 is an enlarged cross-sectional view enlarging and illustrating a neighborhood of a connection terminal in a toilet apparatus according to a second embodiment.

FIG. 12 is an enlarged cross-sectional view enlarging and illustrating a neighborhood of a connection terminal 72 of an electric power supplying system in a toilet apparatus 1 according to a second embodiment. As illustrated in FIG. 12, the second embodiment is configured in such a manner that a switch 73 is inserted between a first connection terminal 72*a* and a second connection terminal 72*b*. Thereby, switching between electric power supplying and electric power supply stopping for a sanitary washing device 30 can readily be executed by a simple configuration.

As described specifically below, the switch 73 includes, for example, an operation part 73*a* that is manually operable by a user. The operation part 73*a* is operated, so that the switch 73 switches between electric power supplying and electric power supply stopping for the sanitary washing device 30. The switch 73 is an example of a switching part that switches electric power supplying and electric power supply stopping for the sanitary washing device 30.

For example, a toggle switch can be used for the switch 73 that is not limited thereto and may be another kind of switch such as a push switch.

A bracket 81 includes an exposure part for switch 183 in an electric power supplying system mounting site 82*b*, as represented with an imaginary line in FIG. 5. The exposure part for switch 183 is an opening with a rectangular shape or a substantially rectangular shape in a plan view.

The exposure part for switch 183 is formed along an outer periphery 81*a* on the bracket 81. In other words, the exposure part for switch 183 is formed at a position closer to a side of a skirt part 15, in detail, a position closer to an inner wall 15*f* of a side face part 15*e* of the skirt part 15, on the bracket 81 in a state where it is installed in a toilet 10.

A shape of the exposure part for switch 183 is not limited to the above-mentioned rectangular shape or substantially rectangular shape, and for example, may be another shape such as a circular shape or an elliptical shape. The exposure part for switch 183 is an opening in the above descriptions and is not limited thereto, and may be, for example, a notch providing by notching the outer periphery 81*a*.

As illustrated in FIG. 12, the above-mentioned exposure part for switch 183 is mounted with the switch 73 and the operation part 73*a* of the switch 73 is exposed to a downside of the bracket 81 through the exposure part for switch 183.

Because the bracket 81 is a mounting part for bracket 18 inside the skirt part 15 as described above, the switch 73 is positioned and fixed at a manually operable position inside the skirt part 15. Specifically, the switch 73 mounted on the bracket 81 is positioned and fixed at a height in a neighborhood of a lower end 15*a* of the skirt part 15. Namely, the fixation member 80 fixes the switching part at a height in a neighborhood of the lower end 15*a* of the skirt part 15.

Thereby, a user manually operates the switch 73, for example, in an event of emergency, so that switching between electric power supplying and electric power supply stopping for the sanitary washing device 30 can be executed more readily.

As described above, the exposure part for switch 183 is formed at a position closer to a side of the skirt part 15 on the bracket 81 (see FIG. 5). Therefore, the switch 73 is positioned and fixed at a position close to a side of the skirt part 15, in detail, a position closer to the inner wall 15*f* of the side face part 15*e* of the skirt part 15, although illustration thereof is omitted. Namely, the fixation member 80 fixes the switching part at a position closer to the skirt part 15.

Thereby, the switch 73 is disposed adjacent to a side of a user that executes a manual operation, as compared with, for example, a case where it is disposed at a position closer to a side of a drain tarp pipeline 13. Accordingly, it is possible for a user to manually operate the switch 73 readily when his or her hand is put in a side of the lower end 15*a* of the skirt part 15, and hence, switching between electric power supplying and electric power supply stopping for the sanitary washing device 30 can be executed more readily.

Because a fourth insertion hole 84*d* and an outer periphery side fourth locking part 85*d*2 are formed in a neighborhood of the exposure part for switch 183 as illustrated in FIG. 5, the switch 73 can be fixed on the bracket 81 more tightly, and positional displacement of the switch 73 can be suppressed. In this specification, a "neighborhood of the exposure part for switch 183" with the fourth insertion hole 84*d* or the like being formed therein means, for example, a range with constraint force of a constraint member 92 being applied to the switch 73 mounted on the exposure part for switch 183 therein.

Both of switching between water supplying and water stopping for the sanitary washing device 30 and switching between electric power supplying and electric power supply stopping for the sanitary washing device 30 are executed in the above-mentioned first or second embodiment that is not limited thereto and may be configured in such a manner that one of such switching operations is executed.

(First Variation)

Next, a variation of the bracket 81 will be described. In the above-mentioned first or second embodiment, the bracket 81 is configured to be mounted on the mounting part for bracket 18 of the toilet 10. On the other hand, in a first variation, a bracket 181 is mounted on the skirt part 15 of the toilet 10.

Figure 13:
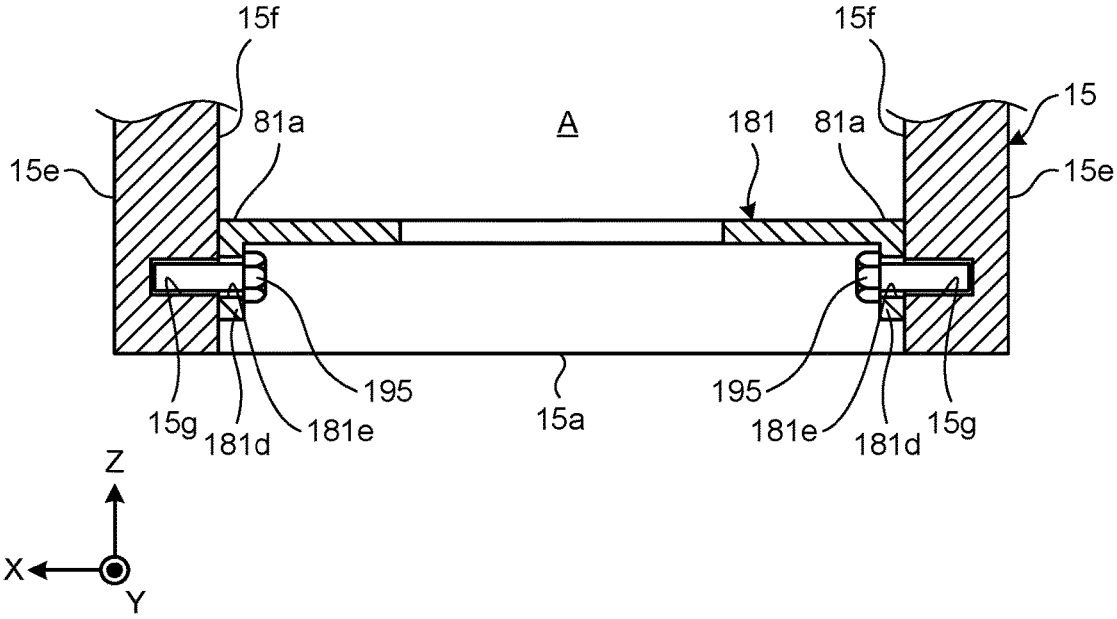
FIG. 13 is a partial cross-sectional view of a bracket according to a first variation.

FIG. 13 is a partial cross-sectional view of the bracket 181 according to the first variation. FIG. 13 is a partial cross-sectional view of the bracket 181 located in the internal space A of the skirt part 15 when viewed from a side of the back face part 15*d*, where some of members such as the first water supplying pipe 61*a* are omitted.

As illustrated in FIG. 13, the bracket 181 includes a wall part 181*d* that is formed so as to extend downwardly from the outer periphery 81*a*. The wall part 181*d* is formed on a part of the outer periphery 81*a* of the bracket 181, for example, a site of the outer periphery 81*a* that is opposite to the inner wall 15*f* of the side face part 15*e* of the skirt part 15, is not limited thereto, and may be formed over all portions of the outer periphery 81*a*.

A screw insertion hole 181*e* is formed on the above-mentioned wall part 181*d*. A female screw hole 15*g* is formed on the inner wall 15*f* of the skirt part 15 at a position corresponding to the screw insertion hole 181*e* of the wall part 181*d*.

Therefore, a mounting screw 195 is inserted through the screw insertion hole 181*e* of the wall part 181*d* of the bracket 181 and subsequently fastened in the female screw hole 15*g*, so that the bracket 181 is mounted on the inner wall 15*f* of the skirt part 15 through the wall part 181*d*. Namely, the bracket 181 is formed into a plate shape or a substantially plate shape and mounted on the inner wall 15*f* of the skirt part 15. Thus, in the first variation, the bracket 181 can readily be installed inside the skirt part 15 of the toilet 10.

(Second Variation)

Figure 14:
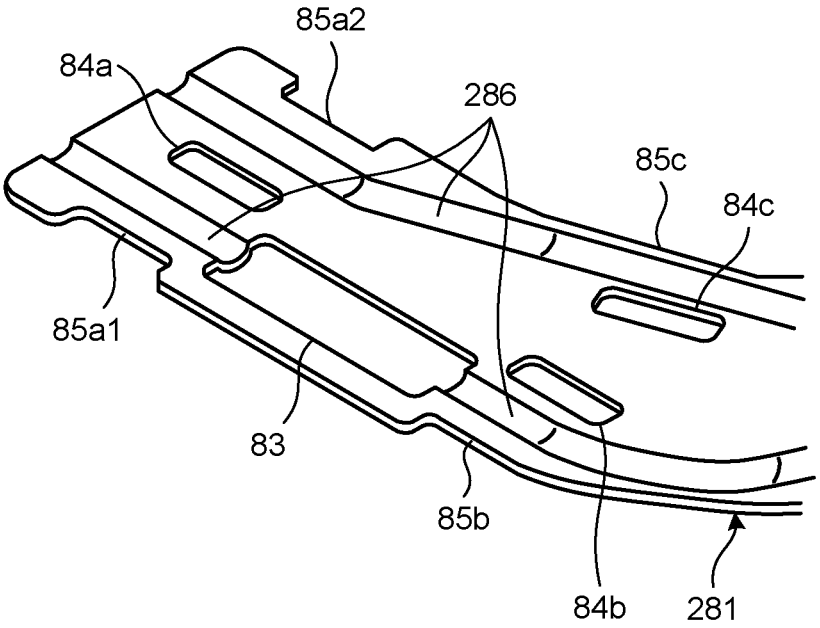
FIG. 14 is a perspective view of a bracket according to a second variation.

FIG. 14 is a perspective view of a bracket 281 according to a second variation. As illustrated in FIG. 14, a groove part 286 is formed on the bracket 281 according to the second variation, at a location where the first or second water supplying pipe 61*a* or 61*b* or the like should be mounted.

Thereby, the groove part 286 functions as a guide part in a case where the first or second water supplying pipe 61*a* or 61*b* or the like is mounted on the bracket 281, and hence, it is possible to readily mount the first or second water supplying pipe 61*a* or 61*b* or the like on the bracket 281.

Because the first or second water supplying pipe 61*a* or 61*b* or the like mounted on the bracket 281 is provided in a state where it is fit to the groove part 286 and is difficult to move, positional displacement of the first or second water supplying pipe 61*a* or 61*b* or the like can be suppressed.

Depending on a depth or a size of the groove part 286, it is possible to tightly fix the first or second water supplying pipe 61*a* or 61*b* or the like on the bracket 281, and in such a case, the constrain member 91, the first to third insertion holes 84*a* to 84*c*, or the first to third locking parts 85*a* to 85*c* may be eliminated.

Although the groove part 286 is formed on an entirety of a location where the first or second water supplying pipe 61*a* or 61*b* or the like should be mounted, in an example as illustrated in FIG. 14, this is illustrative and not limiting, and the groove part 286 may be formed a part thereof.

The bracket 281 may be configured in such a manner that a grove part may be formed at a location where the first or second electric power supply cord 71*a* or 71*b* or the like should be mounted, in addition to or place of the above-mentioned groove part 286, although illustration thereof is omitted.

In the above-mentioned embodiment, a shape of the bracket 81, 181, or 281 is not limited to the above-mentioned substantially U-shape, and it may be formed into, for example, another shape such as a substantially O-shape in a plan view.

The above-mentioned bracket 81, 181, or 281 is provided in such a manner that the water supplying system mounting site 82*a*, the electric power supplying system mounting site 82*b*, and the installed site 82*c* are formed integrally, and is not limited thereto. That is, the bracket 81, 181, or 281 may be provided in such a manner that, for example, the installed site 82*c* is eliminated and the water supplying system mounting site 82*a* and the electric power supplying system mounting site 82*b* are formed separately. In such a case, each of the water supplying system mounting site 82*a* and the electric power supplying system mounting site 82*b* is mounted on the toilet 10.

In the above descriptions, the water supplying system that includes the first water supplying pipe 61*a* or an electric power supplying system that includes the first electric power supply cord 71*a* is mounted on a top face of the bracket 81, 181, or 281, is not limited thereto, and may be located on, for example, a bottom face of the bracket 81, 181, or 281.

A mark for indicating that the valve 60 or the like is present inside the skirt part 15 may be applied to the skirt part 15, although illustration thereof is omitted. Specifically, a mark (for example, a figure, a symbol, a character, or the like) for indicating that the valve 60 or the like is present inside the skirt part 15 may be applied to the skirt part 15 at a position that corresponds to the valve 60, the connection terminal 72, or switch 73, where the position is viewable for a user. Thereby, a user can readily recognize a position of the valve 60 or the like, and hence, it is possible to execute an operation of the valve 60 or the like, early, for example, in an event of emergency.

The above-mentioned positions or numbers of the screw insertion hole 87 or 181*e* and the female screw hole 19 or 15*g* to be formed are merely illustrative, are not limiting, and are changeable appropriately.

In the above descriptions, the toilet 10 is a low-tank-type that executes washing with washing water stored in a tank, is not limited thereto, and may be, for example, a flush-valve-type. In the above descriptions, the washing nozzle 43 washes a private part of a user, is not limited thereto, and may be configured in such a manner that, for example, water is discharged to the sewage-receiving face 16 of the of the toilet 10 before use to suppress attachment of sewage thereto.

According to an aspect of an embodiment as described above, a toilet apparatus includes a wall-mounted-type toilet body, a sanitary washing device, a switching part, and a fixation member. The toilet body includes a skirt part that covers a bowl part that receives sewage and forms an outline of a toilet bowl. The sanitary washing device is provided on a top face of the toilet body and washes a private part of a user. The switching part executes at least one of switching between water supplying and water stopping for the sanitary washing device and switching between electric power supplying and electric power supply stopping for the sanitary washing device, by a manual operation. The fixation member positions and fixes the switching part at a manually operable position inside the skirt part.

Thereby, switching between water supplying and water stopping or switching between electric power supplying and electric power supply stopping, for a sanitary washing device, can readily be executed.

The fixation member positions and fixes the switching part at a height in a neighborhood of a lower end of the skirt part. Thereby, it is possible for a user to put his or her hand inside a skirt part from a lower end side thereof to manually operate a switching part readily, and hence, switching between water supplying and water stopping or switching between electric power supplying and electric power supply stopping, for a sanitary washing device, can be executed more readily.

The fixation member positions and fixes the switching part at a position closer to a side of the skirt part. Thereby, a switching part is disposed adjacent to a side of a user that executes a manual operation, as compared with, for example, a case where it is disposed at a position closer to a side of a drain trap pipeline. Accordingly, when a user puts his or her hand inside a skirt part from a lower end side thereof, it is possible to manually operate a switching part readily, and hence, switching between water supplying and water stopping or switching between electric power supplying and electric power supply stopping, for a sanitary washing device, can be executed more readily.

The fixation member includes a mounting member that is installed in the toilet body, and a constraint member that constrains an extending member that extends from the switching part to fix the switching part on the mounting member. Thereby, a switching part can be positioned and fixed by a simple configuration.

The mounting member is formed into a plate shape or a substantially plate shape, is mounted with the switching part, and has an exposure part formed to expose the switching part to a downside thereof. Thereby, a user can readily access and manually operate a switching part, and hence, can more readily execute switching between water supplying and water stopping or the like for a sanitary washing device.

The mounting member includes a mounting part for constraint member that is formed in a neighborhood of the exposure part and mounted with the constraint member. Thereby, a switching part mounted on an exposure part can tightly be fixed on a mounting member by a constraint member, and positional displacement of the switching part can be suppressed.

The mounting member includes a mounting part for constraint member that is mounted with the constraint member. The mounting part for constraint member is formed at a position on the mounting member where the extending member is constrained to have a predetermined curved shape. Thereby, it is possible to ensure a minimum bending radius of an extending member, and hence, occurrence of a kink can be prevented.

The mounting member is formed into a plate shape or a substantially plate shape and mounted on an inner wall of the skirt part through a wall part formed on an outer periphery thereof. Thereby, a mounting member can readily be installed inside a skirt part of a toilet body.

The switching part includes at least one of a valve that switches between water supplying and water stopping for the sanitary washing device, and a connection terminal and a switch that switch between electric power supplying and electric power supply stopping for the sanitary washing device. Thereby, switching between water supplying and water stopping or switching between electric power supplying and electric power supply stopping, for a sanitary washing device, can readily be executed by a simple configuration.

According to an aspect of an embodiment, switching between water supplying and water stopping or switching between electric power supplying and electric power supply stopping, for a sanitary washing device, can readily be executed in a toilet apparatus.

Additional advantages and modifications will readily occur to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

What is claimed is:

1. A toilet apparatus, comprising:

a wall-mounted toilet body that includes a skirt part that forms an outline of a toilet bowl, the wall-mounted toilet body being mounted on a wall that stands on a floor face while interposing a gap between the toilet body and the floor face;

a sanitary washing device that is disposed on a top face of the toilet body and washes a private part of a user;

a switching part that includes at least one of a first switching part for switching between a supply and a stop of water to the sanitary washing device, and a second switching part for switching between a supply and a stop of electric power to the sanitary washing device; and a fixation member that is installed in the skirt part to form a bottom surface of the toilet body, and fixes the switching part at a position inside the skirt part so that the switching part is accessible from the gap, wherein the fixation member comprises:

a mounting member that is attached to the toilet body from the gap between the toilet body and the floor face; and at least one constraint member that constrains, to the mounting member, an extending member that extends from the switching part such that the switching part is fixed on the mounting member.

2. The toilet apparatus according to claim 1, wherein the fixation member fixes the switching part at a height within a predetermined distance in an upward direction from a lower end of the skirt part.

3. The toilet apparatus according to claim 1, wherein the switching part is arranged, in the skirt part, between an outer periphery of the skirt part and a drain trap pipeline arranged under the toilet bowl, and the fixation member fixes the switching part at a position closer to an outer periphery of the skirt part.

4. The toilet apparatus according to claim 1, wherein the mounting member is formed into a substantially plate shape, the switching part is mounted on the mounting member, and the mounting member has an opening that is configured such that the switching part can be accessed from the gap between the toilet body and the floor face.

5. The toilet apparatus according to claim 4, wherein the mounting member includes mounting parts that interpose the opening therebetween and on which the at least one constraint member is mounted.

6. The toilet apparatus according to claim 1, wherein:

the mounting member includes a mounting part on which the constraint member is mounted; and the mounting part is formed at a position on the mounting member where the mounting part constrains the extending member such that the extending member has a predetermined curved shape.

7. The toilet apparatus according to claim 1, wherein the mounting member is formed into a substantially plate shape and mounted on an inner wall of the skirt part.

8. The toilet apparatus according to claim 1, wherein the switching part includes at least one of a valve and a switch, the valve switching between the supply and the stop of water to the sanitary washing device, and the switch switching between the supply and the stop of electric power to the sanitary washing device.

9. A toilet apparatus, comprising:

a wall-mounted toilet body that includes a skirt part that forms an outline of a toilet bowl, the wall-mounted toilet body being mounted on a wall that stands on a floor face while interposing a gap between the toilet body and the floor face;

a sanitary washing device that is disposed on a top face of the toilet body and washes a private part of a user;

a switching part that includes at least one of a first switching part for switching between a supply and a stop of water to the sanitary washing device, and a second switching part for switching between a supply and a stop of electric power to the sanitary washing device;

a fixation member that is installed in the skirt part to form a bottom surface of the toilet body, and fixes the switching part at a position inside the skirt part so that the switching part is accessible from the gap; and a constraint member that constrains, in the skirt part, an extending member extending from the switching part.

* * * * *